US005705897A

United States Patent [19]

Hanazaki et al.

[11] Patent Number: 5,705,897

[45] Date of Patent: Jan. 6, 1998

[54] APPARATUS FOR LIGHTING ALTERNATING CURRENT DISCHARGE LAMP

[75] Inventors: Yasumasa Hanazaki; Kenji Nakamura, both of Hyogo, Japan

[73] Assignee: Mitsubishi Denki Kabushiki Kaisha, Tokyo, Japan

[21] Appl. No.: 795,134

[22] Filed: Feb. 7, 1997

Related U.S. Application Data

[63] Continuation of Ser. No. 345,829, Nov. 21, 1994, abandoned.

[30] Foreign Application Priority Data

Jul. 12, 1994 [JP] Japan ..... 6-160364

[51] Int. Cl.[6] ..... H05B 37/02

[52] U.S. Cl. ..... 315/307; 315/224; 315/DIG. 7; 315/219

[58] Field of Search ..... 315/307, 308, 315/291, 205, 309, 106, 107, DIG. 7, DIG. 5, 102, 82, 219, 360, 224

[56] References Cited

U.S. PATENT DOCUMENTS

| | | | |
|---|---|---|---|
| 4,709,188 | 11/1987 | Roberts | 315/307 |
| 5,068,578 | 11/1991 | Wegener | 315/307 |
| 5,103,143 | 4/1992 | Daub | 315/308 |
| 5,140,229 | 8/1992 | Yagi et al. | 315/307 |
| 5,151,634 | 9/1992 | Nepote et al. | 315/307 |
| 5,262,701 | 11/1993 | Derra et al. | 315/224 |
| 5,434,474 | 7/1995 | Ukita | 315/128 |
| 5,589,742 | 12/1996 | Ueda | 315/307 |

FOREIGN PATENT DOCUMENTS

| | | | |
|---|---|---|---|
| 0477922 | 4/1992 | European Pat. Off. | 315/309 |
| 3928810A1 | 3/1991 | Germany . | |
| 4015398A1 | 11/1991 | Germany . | |
| 4136486A1 | 5/1993 | Germany . | |
| 4313915A1 | 10/1993 | Germany . | |
| 63-87598 | 3/1988 | Japan . | |
| HEI3283394 | 12/1991 | Japan . | |
| 4272697A | 9/1992 | Japan . | |

*Primary Examiner*—Robert Pascal
*Assistant Examiner*—Arnold Kinkead

[57] ABSTRACT

An alternating current discharge lamp lighting apparatus including discharge lamp, tube wall temperature measuring unit, internal temperature inferring unit and period setting unit. The tube wall temperature measuring unit measures temperature of the tube wall of the discharge lamp. The internal temperature inferring unit infers internal temperature of the discharge lamp before discharge is started based on the tube wall temperature measured by the tube wall temperature measuring unit. The period setting unit sets a direct current voltage applying period based on the inferred internal temperature by the internal temperature inferring unit.

27 Claims, 38 Drawing Sheets

APPARATUS FOR LIGHTING ALTERNATING CURRENT DISCHARGE LAMP

This application is a continuation of application Ser. No. 08/345,829 filed on Nov. 21, 1994, now abandoned.

BACKGROUND OF THE INVENTION

1. Field of the Invention

The present invention relates to a lighting apparatus for an alternating current discharge lamp such as a high-pressure mercury lamp and a metal halide lamp.

2. Description of the Prior Art

A prior art alternating current discharge lamp lighting apparatus is disclosed in Japanese Laid-Open Patent Application HEI 3-283394.

This lighting apparatus will be explained with reference to the drawings.

FIG. 37 is a block diagram showing a structure of the prior art alternating current discharge lamp lighting apparatus. FIG. 38 is a circuit diagram corresponding to a part of the block diagram of FIG. 37. In FIGS. 37 and 38 reference numeral 12 denotes a high-pressure discharge lamp such as a metal halide lamp which is driven, for example, at 90 volts, 200 watts. Reference numeral 27 denotes an alternating current power source. Reference numeral 2 denotes a lighting switch. Reference numeral 28 denotes a rectifying and smoothing circuit which rectifies the output of the alternating current power source 27 and which produces a direct current. Reference numeral 29 denotes a chopper circuit which includes MOS FETs (Metal Oxide Semiconductor Field Effect Transistors) and whose on-off operation is performed at high frequency under control of the chopper drive control circuit 30. The peak current control method described in Japanese Laid Open Patent Application SHO 63-187598 can be used for the on-off operation. The smoothing circuit 31 is connected to the output terminals of the chopper circuit 29 for removing radio frequency ripples. Direct current outputted from the smoothing circuit 31 is inputted to the polarity switching circuit 32. The polarity switching circuit 32 includes MOS FETs 32*a*–32*d* in the full bridge structure, which perform the on-off operation by which a low frequency signal is outputted to the discharge lamp 12. The control of the on-off operation of the FETs 32*a*–32*d* is performed by the lighting detection circuit 33, the polarity switching drive circuit 34 and polarity switching delay circuit 35 upon detecting a current flowing from polarity switching circuit 32 into the discharge lamp 12. Reference numeral 36 denotes a starter which generates a high voltage signal. A lighting circuit of this structure starts with performing dielectric breakdown between electrodes of the discharge lamp 12 by applying a high voltage pulse (approx. 15 kV) generated by the starter 36 to the discharge lamp 12. A voltage from the polarity switching circuit 32 is applied to the starter 36 and the polarity of the high voltage pulse is constant. To avoid instability of lighting or light being extinguished, the polarity switching circuit 32 is controlled to keep outputting a direct current obtaining a stable condition. The polarity of the direct current is opposite to that of high voltage pulse to be applied to the discharge lamp 12.

Referring to FIG. 38, a method will be explained in detail about continuously outputting a direct current from the polarity switching circuit 32 for a period of 1 second after dielectric breakdown of the discharge lamp. When the lighting switch 2 is tuned on, the Integral Circuit (IC) 1, such as TC4047BP manufactured by TOSHIBA Corporation, outputs a constant level signal, for example logical "H", to the transistor Tr1 through the resistor R2, thereby the transistor Tr1 is turned on. On the other hand, the transistor Tr2 is turned off at this time. A current by the reference voltage $V_{ref2}$ flows through the transistor Tr1, photo-coupler PC1, photo-coupler PC4 and the resistor R4. Signals from the photo-couplers PC1 and PC4 initiate driving circuits for MOS FET 32*a* and MOS FET 32*d* thereby these FETs are turned on. As a result, a current from the polarity switching circuit 32 is supplied to the discharge lamp 12. A current does not flow through the resistor R10 until the dielectric breakdown takes place in the discharge lamp 12. After the dielectric breakdown, a current begins to flow through the resistor R10 thereby producing a signal which is inputted to the operational amplifier OP1 where the signal is compared with the reference voltage $V_{ref1}$ and outputs the difference signal to the polarity switching delay circuit 35. The polarity switching delay circuit 35 is constituted of the resistor R1 and the capacitor C1 which form a time constant circuit. The polarity switching delay circuit 35 delays a signal outputted from the operational amplifier OP1 for a period determined by the values of the resistor R1 and capacitor C1. The delayed signal is inputted to the IC 1. Upon receiving a signal from operational amplifier OP1, the IC 1 outputs low frequency pulses which alternate between "H" level and "L" level. When the IC 1 receives "H" level, a current flows in the way described above. On the other hand, when the IC 1 receives "L" level, the transistor Tr2 is turned on. In this case, a current by the reference voltage $V_{ref2}$ flows through the resistor R3, the photo-couplers PC 3, PC 2 and transistor Tr2 thereby driving circuits for MOS FET 32*b* and MOS FET 32*c* are initiated and these FETs 32*b* and 32*c* are turned on. The delay period can be set properly, for example at 0.5 seconds, provided that the period is within 1 second from the time when the dielectric breakdown takes place. The discharge lamp 12 is designed to receive alternating currents and therefore, providing a direct current to the discharge lamp for longer than 1 second may give a serious damage to the lamp.

A time period from the time when the lamp is extinguished after the lamp is lit till the time when the lamp is lit again varies from time to time. For example, there is a case where the lamp is lit when the lamp is sufficiently cold after a long period of time elapsed after the extinguishment (hereinafter referred to as a cold start) and there is another case where the lamp is lit when the lamp is still hot shortly after it is extinguished (hereinafter referred to as a hot start). Internal conditions of the discharge lamp such as gas temperature, electrode temperature, gas pressure, vapor metal components are completely different depending on the timing of lighting the lamp.

In the conventional lighting apparatus as described above, the time period of supplying a direct current is constant without taking the internal conditions of the discharge lamp into consideration. Therefore, there arises a problem that a discharge lamp flickers or extinguishes during a period in which a direct current is being supplied to the lamp or when a current to be supplied to the lamp is changed from a direct current to an alternating current. Further, there arises another problem that power of a direct current supplied to the lamp is beyond the power limit of the lamp and this gives a damage to the lamp.

SUMMARY OF THE INVENTION

This invention is made in order to resolve the above problem and therefore, the object of the invention is to provide an alternating current discharge lamp lighting apparatus which prevents a light from flickering, being extinguished immediately after the lamp is lit or being supplied overpower.

To accomplish the object, the alternating current discharge lamp lighting apparatus of this invention includes means for generating direct current power; voltage applying means for applying a direct current voltage and alternating current voltage to the discharge lamp by switching the direct current power; a first internal state inferring means for inferring internal state of the discharge lamp; means for setting a period during which the direct current voltage is applied to the discharge lamp based on the internal state of the discharge lamp; means for controlling the voltage applying means in such a way that the direct current voltage is applied to the discharge lamp for the period upon receiving an instruction to start lighting the discharge lamp and the alternating current is applied to the discharge lamp after the period elapses.

Thus, a lighting control can be performed corresponding to the various internal states of the discharge lamp before discharge such as a cold start and a hot start. Further, there is no damage given to the discharge lamp because the power to be supplied to the discharge lamp during a period in which a direct current is being supplied to the discharge lamp is optimum. Furthermore, during a period of applying a direct current voltage to the discharge lamp and when the this period is shifted to a period in which an alternating current voltage is applied to the discharge lamp, extinguishing or flickering of the lamp is avoided.

When the apparatus is constituted such that the internal state of the discharge lamp is inferred by measuring a tube wall temperature of the discharge lamp which is nearly equal to the internal temperature, the inferred state is close to the real internal state and the optimal direct current voltage applying period corresponding to the real internal state of the discharge lamp can be obtained.

When the apparatus is constructed such that the temperature of the enclosure which encloses the discharge lamp is measured to infer the internal state of the discharge lamp, the operation to attach the temperature measuring unit to the lamp can be omitted and the temperature measuring unit does not block the light emitting from the discharge lamp.

When the apparatus is constructed such that the internal state of the discharge lamp is inferred by calculating a lighting state discriminant number, the temperature measuring unit can be omitted thereby the apparatus can be made at low cost and it is not subject to the temperature of the atmosphere.

When the apparatus is constituted such that the internal state of the discharge lamp is inferred by voltage change rate from the DC stepping up unit after the time when the output becomes minimum after dielectric break down takes place, the optimal direct current voltage applying period can be set before memorizing voltage outputted from the DC stepping up unit in lighting at rated power. Further, the temperature measuring unit can be omitted thereby the apparatus can be made at low cost and it is not subject to the temperature of the atmosphere.

When the apparatus is constituted such that the internal state of the discharge lamp is inferred by counting non-lighting time of the discharge lamp, the temperature measuring unit can be omitted thereby the apparatus can be made at low cost and it is not susceptible to noise.

When the apparatus is constituted such that non-lighting time is not counted after a certain amount of time period elapses from the time when the lamp is extinguished, the power consumption during non-lighting can be reduced.

When the apparatus is constituted such that the internal state of the discharge lamp before discharge is inferred by inference of the internal state at the time when the lamp is extinguished and the non-lighting time of the discharge lamp, the inferring the internal state can be more accurate.

When the apparatus is constituted such that the internal state of the discharge lamp at the time when the lamp is extinguished is inferred by measuring lighting time of the lamp, it is not susceptible to noise.

When the apparatus is constituted such that the internal state of the discharge lamp at the time when the lamp is extinguished by calculating a non-lighting state discriminant number, it is not subject to the temperature of the atmosphere.

When the apparatus is constituted such that the internal state of the discharge lamp at the time when the lamp is extinguished is inferred by calculating a voltage change rate of voltage outputted from the DC stepping unit before extinguishment of the lamp, the internal state of the discharge lamp can be inferred at the time when the lamp is extinguished before memorizing the voltage outputted from the DC stepping up unit in lighting at rated power and it is not subject to the temperature of the atmosphere.

DETAILED DESCRIPTION OF THE PREFERRED EMBODIMENTS

The preferred embodiments of this invention will be explained in detail with reference to the drawings.

Embodiment 1

Figure 1:
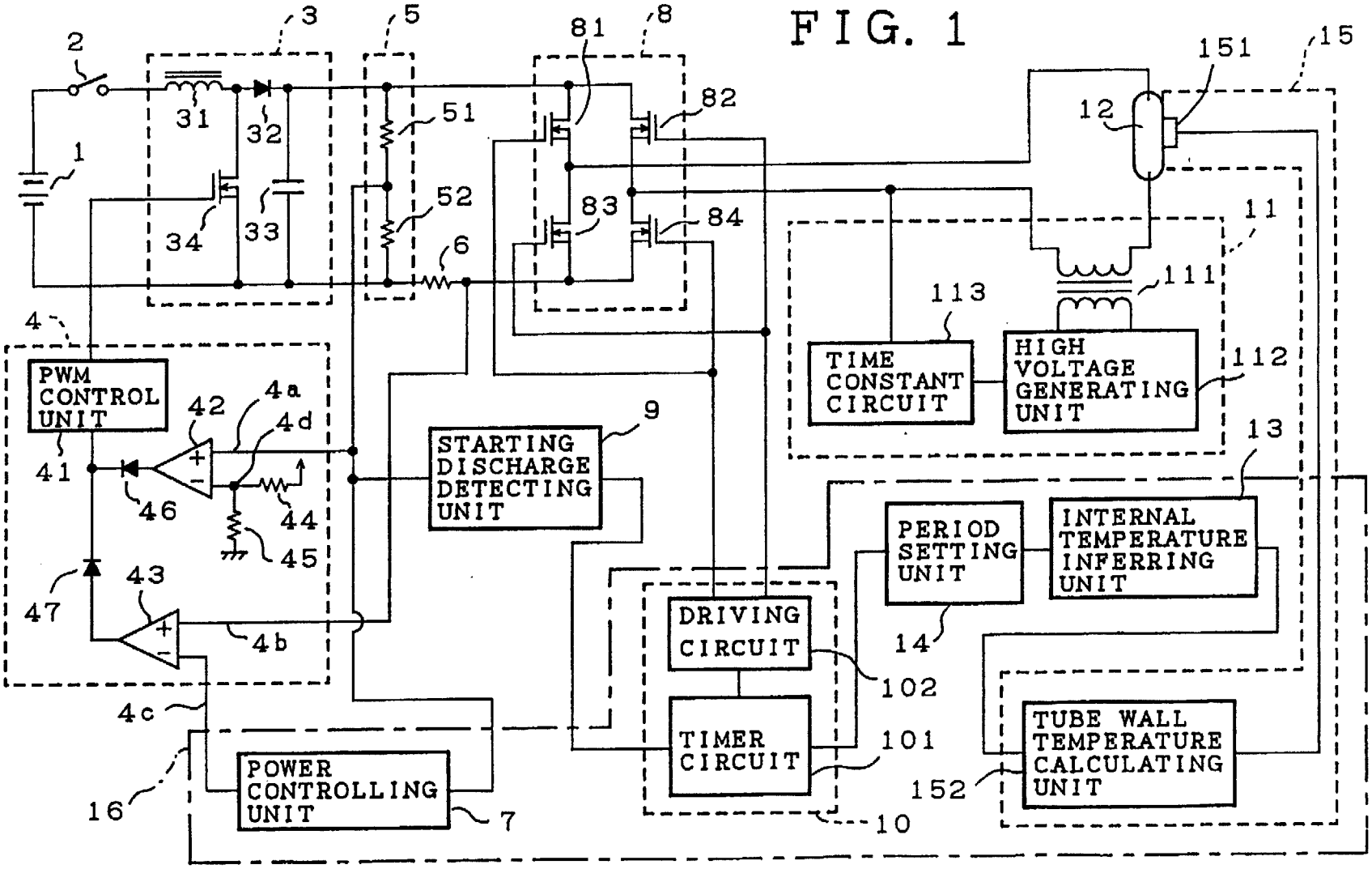
FIG. 1 is a schematic drawing the structure of the embodiment 1 of the invention.

FIG. 1 is a schematic drawing showing a structure of an alternating current discharge lamp lighting apparatus in accordance with the embodiment 1 of the invention.

Figure 2:
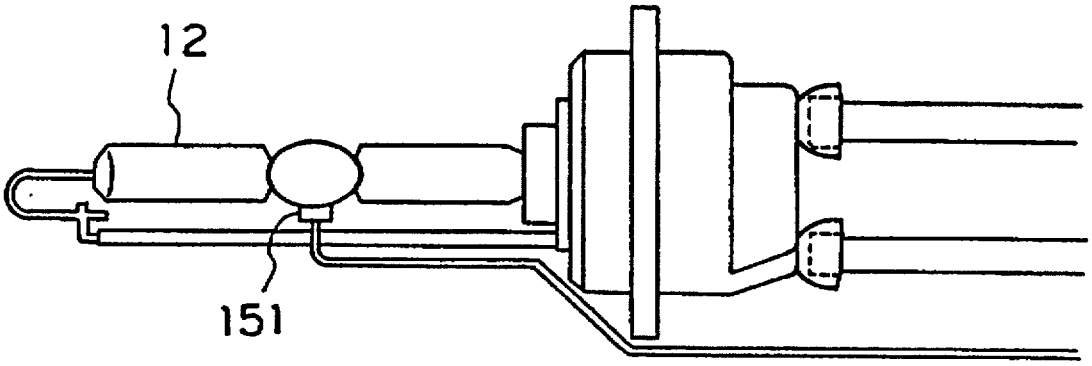
FIG. 2 is a drawing showing a thermo-couple attached to the discharge lamp.

In FIG. 1, reference numeral 1 denotes a direct current power supply, 2 denotes a lighting switch, 3 denotes a Direct Current (DC) stepping up unit which adopts a stepping up type chopper structure. The DC stepping up unit 3 is constituted of the coil 31, the diode 32, the capacitor 33 and the switching element 34. Reference numeral 4 denotes a stepping up control unit which is constituted of the Pulse Width Modulation (PWM) control unit 41, the error amplifiers 42, 43, the resistors 44, 45, and diodes 46, 47. The PWM control unit 41 increases a stepping up degree of DC stepping up unit 3 when an output level of error amplifier 42 or 43 is low by increasing the on-duty of the signal to be inputted to the switching element 34. On the other hand, when an output level of error amplifier 42 or 43 is high, the PWM control unit 41 decreases a stepping up degree by decreasing the on-duty of the signal to be inputted to the switching element 34. The error amplifiers 42 and 43 are connected to the PWM control unit 41 in a wired OR structure. Thus, a higher voltage signal between outputs from the amplifiers 42 and 43 is inputted to the PWM control unit 41. Reference numeral 5 denotes a voltage detecting unit which is constituted of resistors 51 and 52. Reference numeral 6 denotes a resistor for detecting a current. Reference numeral 7 denotes a power controlling unit which outputs a signal indicative of a power level, i.e., a current level to be supplied to the discharge lamp 12 based on the input from voltage detecting unit 5. A discharge lamp current value which the output voltage value of the power controlling unit indicates is the same as a current value which the voltage generated at resistor 6 means. For example, if a current flowing through the resistor 6 is 1 [A] when a voltage generated at the resistor 6 is 1 [V], an output voltage of 1 [V] indicates discharge lamp current 1[A]. Reference numeral 8 denotes a discharge lamp applying voltage generating unit which is in a full bridge structure including switching elements 81–84. Reference numeral 9 denotes a starting discharge detecting unit which detects a trailing edge of the voltage detected by voltage detecting unit 5. When the starting discharge detecting unit 9 detects the trailing edge, the unit 9 judges that the starting discharge is successfully performed and sends a signal indicating a success of starting discharge to the timer circuit 101. Reference numeral 10 denotes a driver unit which is constituted of the timer circuit 101 and the driving circuit 102. The driving unit 10 includes output terminals for making the switching elements 81–84 on and off. These output terminals are connected to the Gates of the switching elements 81–84. The driving circuit 102 sends, to the switching elements 81–84, signals indicating that the switching elements 81 and 84 are switched on and off in a same phase at a frequency f1, that the switching elements 82 and 83 are switched on and off in a same phase at the same frequency f1, that the phase difference between the switching of the element 81 and the switching of the element 82 is $\pi$ radian, and that there is a dead time period in which all the elements 81–84 are in off-state. The timer circuit 101 counts a time period from the time when the circuit 101 receives a signal from the starting discharge detecting unit 9. Namely, the timer circuit 101 counts a direct current voltage applying period. Reference numeral 11 denotes a starting discharge unit which is constituted of the transformer 111, high voltage generating unit 112 and time constant circuit 113. Reference numeral 13 denotes an internal temperature inferring unit which infers an internal temperature of the discharge lamp 12 before discharge. Reference numeral 14 denotes a period setting unit which sets a direct current voltage applying period based on an internal temperature before discharge, inferred by the internal temperature inferring unit 13. Reference numeral 15 denotes a tube wall temperature measuring unit which measures a tube wall temperature of discharge lamp 12 before discharge. The tube wall temperature measuring unit 15 includes a thermo-couple 151 attached to the wall of the discharge lamp 12 as depicted in FIG. 2 and the tube wall temperature calculation unit 152 which calculates a tube wall temperature of the discharge lamp 12 based on the voltage produced at the thermo-coupling 151.

Figure 3:
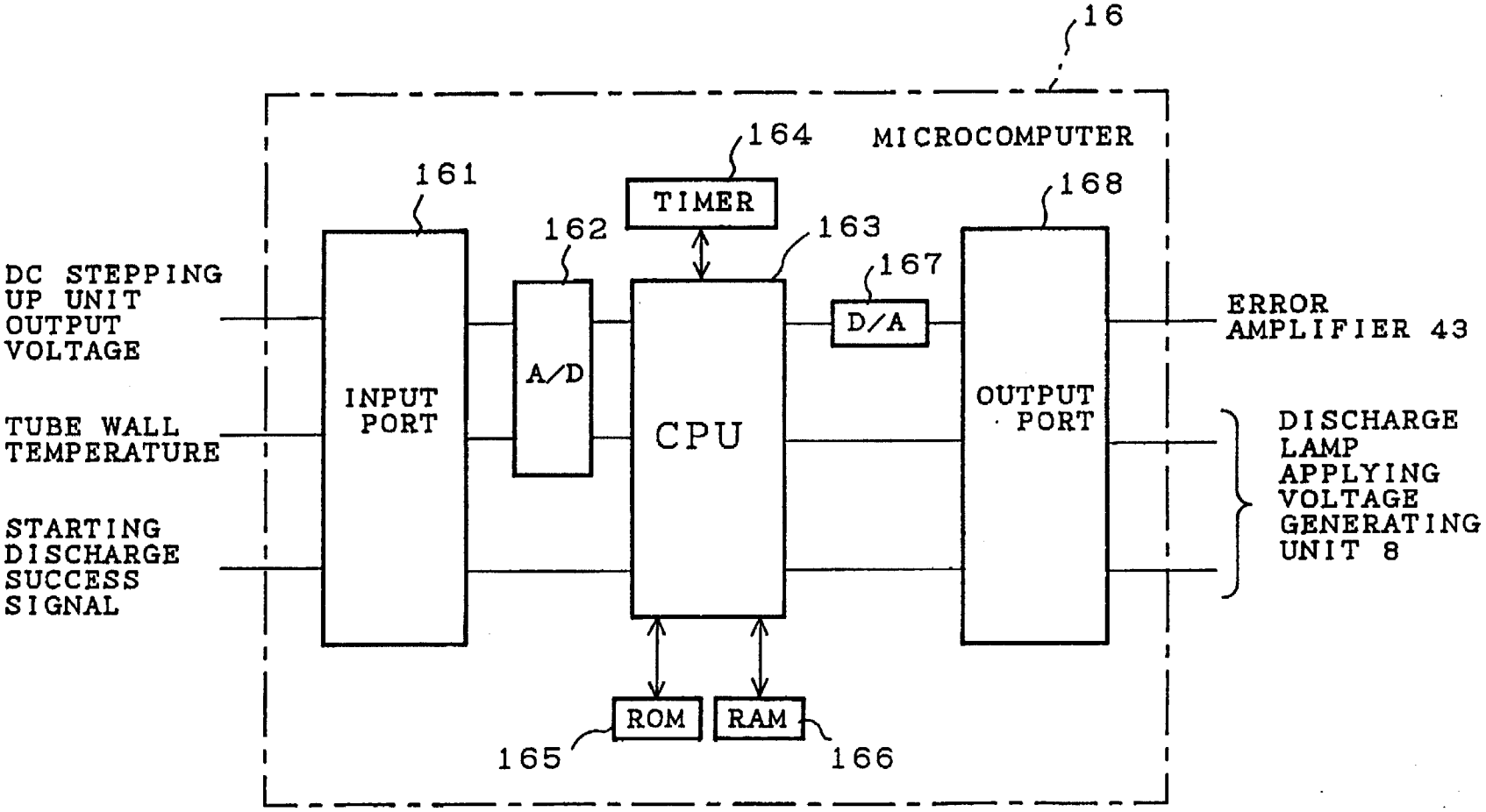
FIG. 3 is a block diagram in which a part of the elements is constituted by a microcomputer.

FIG. 3 is a block diagram in which the power controlling unit 7, the driver unit 10, the internal temperature inferring unit 13, the period setting unit 14 and the tube wall temperature calculating unit 152 are realized by using a microcomputer 16. The microcomputer 16 includes the input port 161, the A/D converter 162, the Central Processing Unit (CPU) 163, the timer 164, the Read Only Memory (ROM) 165, the Random Access Memory (RAM) 166, the D/A converter 167 and the output port 168.

Figure 4:
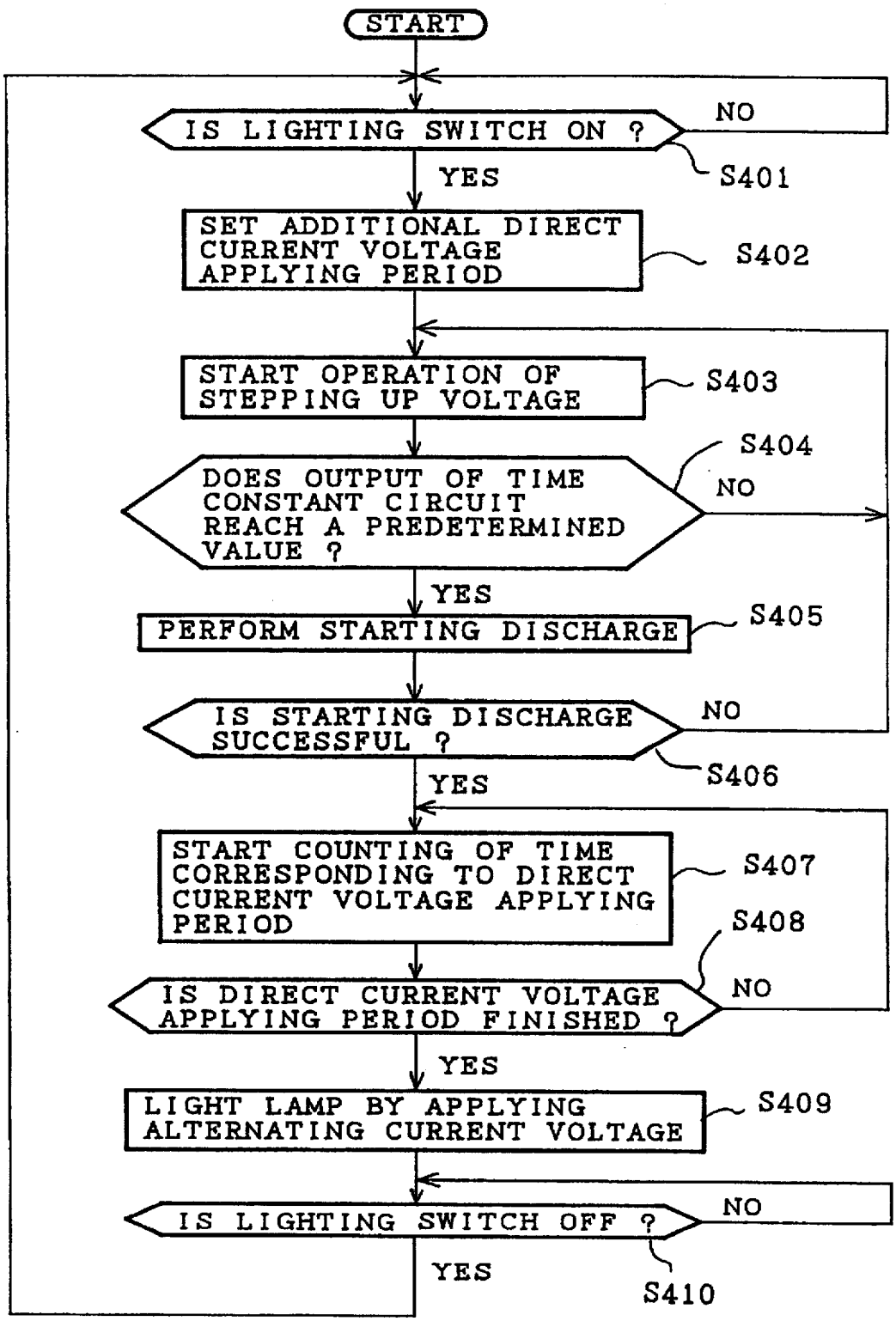
FIG. 4 is a flowchart showing general operations of the embodiment 1.

FIG. 4 is a flowchart showing a general operation of the alternating current discharge lamp lighting apparatus of the embodiment 1.

Figure 5:
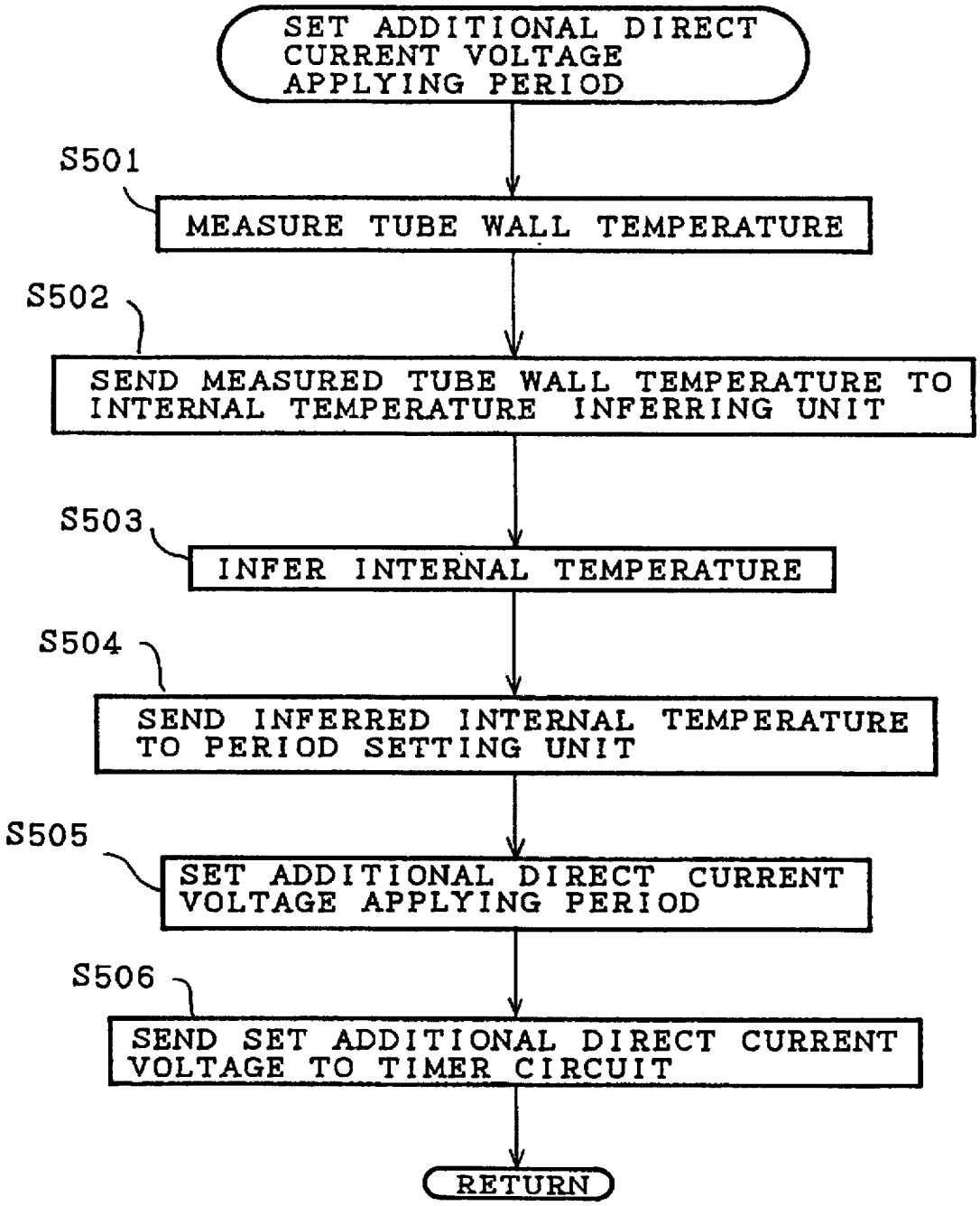
FIG. 5 is a flowchart showing the operation of setting an additional direct current voltage applying period.

When the lighting switch 2 is turned on at step S401, an additional direct current voltage applying period $t_{c2}$ is set at step S402. The operation of setting an additional direct current voltage applying period $t_{c2}$ will be explained with reference to FIG. 5. The tube wall temperature measuring unit 15 measures a tube wall temperature $T_{k1}$ of the discharge lamp 12 at step S501. Thus, when the tube wall temperature is low, the internal temperature is also low and it is considered that this is a cold start. On the other hand, when the tube wall temperature is high, the internal temperature is also high and it is considered that this is a hot start. That is, the internal temperature of the discharge lamp 12 can be known by measuring a tube wall temperature $T_{k1}$ of the discharge lamp 12. The tube wall temperature measuring unit 15 sends value data of the measured tube wall temperature $T_{k1}$ Of the discharge lamp 12 to the internal temperature inferring unit 13 at step S502. The internal temperature inferring unit 13 has a table of tube wall temperature—internal temperature characteristics stored in the ROM 165 of microcomputer 16. The table shows the relationship between tube wall temperatures of the discharge lamp 12 and internal temperatures corresponding to the tube wall temperatures respectively. When the data of the tube wall temperature $T_{k1}$ is sent from the tube wall temperature measuring unit 15, an internal temperature of the discharge lamp 12 is inferred based on the table of tube wall temperature—internal temperature characteristics at step S503. The internal temperature inferring unit 13 sends data of the inferred internal temperature of discharge lamp 12 to the period setting unit 14. The period setting unit 14 has a table of internal temperature—additional direct current voltage applying period characteristic stored in the ROM 165 of the microcomputer 16. The table of internal temperature—additional direct current voltage applying period characteristic shows the relationship between internal temperatures of the discharge lamp 12 and the optimum additional direct current voltage applying period $t_{c2}$ corresponding to the internal temperatures respectively. When the internal temperature inferring unit 13 sends the data of internal temperature of the discharge lamp 12, an additional direct current voltage applying period $t_{c2}$ corresponding to the internal temperature is set based on the table of internal temperature—additional direct current voltage applying period characteristic at step S505. The period setting unit 14 sends the data of the set additional direct current voltage applying period $t_{c2}$ to the timer circuit 101.

Concurrently with the operation of setting additional direct current voltage applying period as described above, the stepping up control unit 4 begins to operate in such a way that the unit 4 steps up the voltage of the direct current power supply 1 by making the switching element 34 on and off at step S403. During the on-period of the switching element 34, the power supply 1, coil 31, switching element 34 form a loop and electromagnetic energy is accumulated at the coil 31 because of a current flowing from the power supply 1 through this loop. During the off-period of the switching element 34, the coil 31, diode 32, capacitor 33 form a loop and the electromagnetic energy accumulated at the coil 31 during the on-period of the switching element 34 is discharged through the diode 32 to the capacitor 33. The electromagnetic energy is converted into electrostatic energy and the converted electrostatic energy is accumulated in the capacitor 33. Thus, a voltage due to the electrostatic energy is superimposed to a voltage of the power supply 1 and the superimposed voltage is emerged between both terminals.

The voltage between both terminals, i.e., output voltage $V_o$ of the DC stepping up unit 3 is gradually stepped up by continuously switching the switching element 34 at the frequency f while on-off duty is being varied. The on-off duty of switching of the switching element 34 is varied depending on inputs from terminals 4a, 4b and 4c of the stepping up control unit 4.

Figure 6:
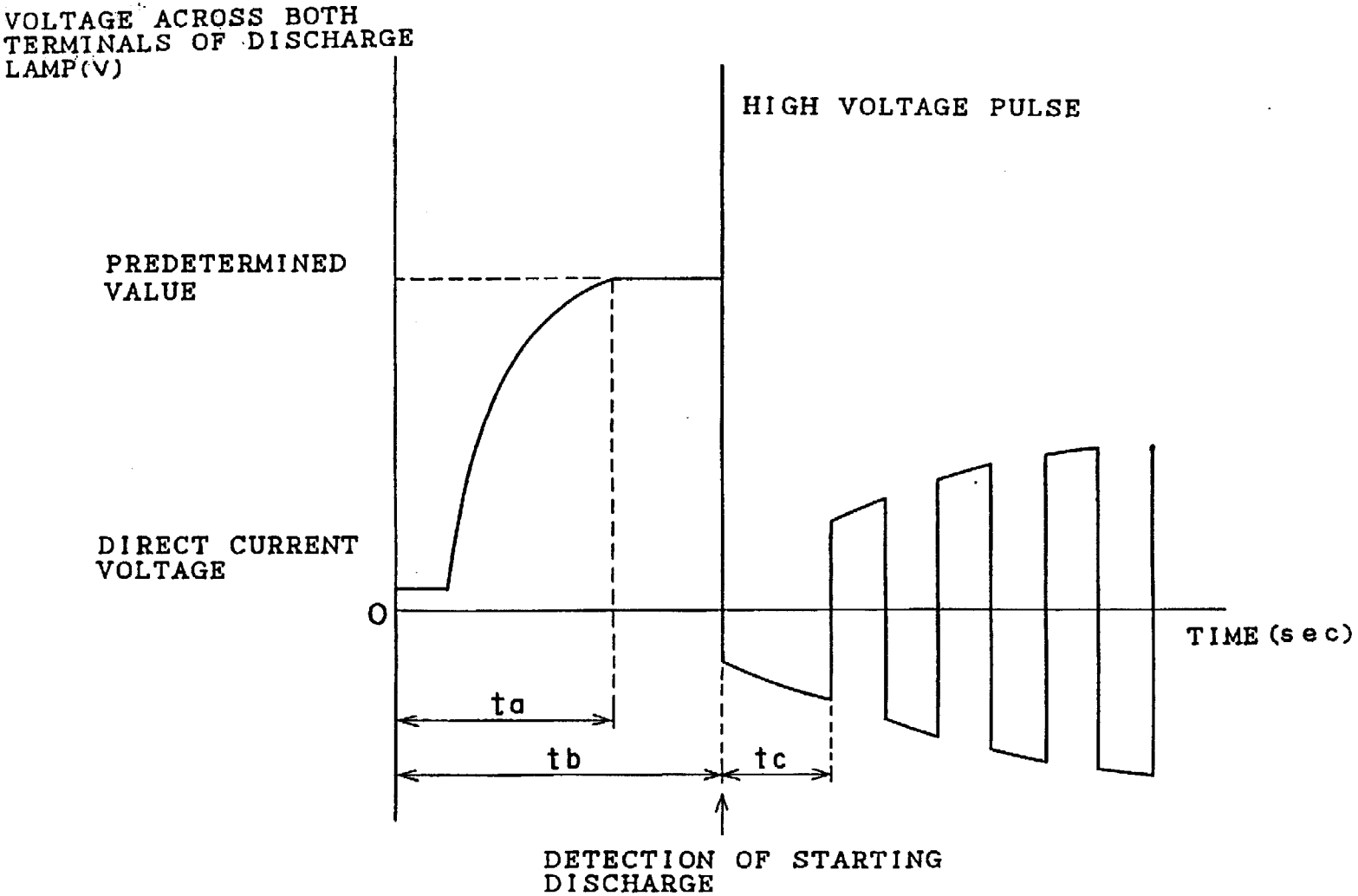
FIG. 6 is a graph showing the relationship between voltage applied to he discharge lamp and elapsing time.

FIG. 6 is a graph showing a voltage change between both terminals of the discharge lamp 12 at the time when the starting discharge is performed. The fixed voltage $V_d$ is produced at the point 4d by dividing the reference voltage with resistors 44 and 45. The voltage $V_d$ is inputted to the inverted input of the error amplifier 42. The output voltage $V_o$ of the DC stepping up unit 3 is divided by the resistors 51 and 52, and the voltage $V_a$ at the point 4a is inputted to the non-inverted input of the error amplifier 42. The error amplifier 42 amplifies the difference voltage between the voltage $V_d$ and the voltage $V_a$. The voltage $V_d$ is set such that the voltage $V_d$ is the same as the voltage $V_a$ at the time when the voltage $V_o$ is a predetermined voltage PV1, for example, 400 [V]. When the lighting switch 2 is turned on, the output voltage $V_o$ of the DC stepping up unit 3 is lower than the predetermined value PV1 and the output of the error amplifier 42 becomes low level. Thus, the PWM control unit 41 increases the on-duty of a signal to be supplied to the gate of the switching element 34 thereby the step up degree of the output voltage $V_o$ from the DC stepping up unit 3 is increased. As the voltage $V_o$ increases and comes close to the predetermined value PV1, the PWM control unit 41 decreases the step up degree by decreasing the on-duty of the signal to be supplied to the gate of the switching element 34. After the output voltage $V_o$ reaches the predetermined value PV1, i.e., $V_d=V_a$, the output voltage $V_o$ is maintained. Let a time period from the time when the lighting switch is turned on till the output voltage $V_o$ reaches the predetermined value PV1 be $t_a$. At this time, a current does not flow through the resistor 6, i.e., the voltage $V_b$ at the point 4b is zero. Thus, the output level of the error amplifier 43 is lower than that of the error amplifier 42 and the output signal of the error amplifier 43 is not inputted to the PWM control unit 41 so that it is not related to the stepping up operation.

Concurrently with the operation described above, the driving circuit 102 keeps the switching elements 81 and 84 continuously on and the circuit 102 keeps the switching elements 82 and 83 continuously off. Therefore, the direct current voltage $V_o$ from the DC stepping up unit 3 is applied to the discharge lamp 12 as it is.

The output voltage $V_o$ from DC stepping up unit 3 is inputted to the time constant circuit 113 of the starting discharge unit 11 through the discharge lamp applying voltage generating unit 8. When the output signal from the time constant circuit 113 reaches a predetermined value PV2 at step S404, an impulse voltage is applied to the transformer 111 from the high voltage generating unit 112 and the starting discharge is performed by applying a high voltage pulse to the discharge lamp 12 at step S405. The time period $t_b$ till the output voltage of the time constant circuit 113 reaches the predetermined value PV2 is longer than or equal to the time period $t_a$ till the output voltage $V_o$ reaches the predetermined value PV1.

When a current begins to flow through the discharge lamp 12 and the starting discharge begins to take place, a state of the output of the DC stepping up unit 3 is changed from a non-load state to a load state, thereby the output voltage $V_o$ of the DC stepping up unit 3 drops suddenly. This sudden voltage drop is detected by the starting discharge detecting unit 9 and the unit 9 sends a signal indicative of the sudden voltage drop to the timer circuit 101. When it is judged that the starting discharge has been unsuccessful at step S406, the sequence moves back to step S403 where the stepping up operation is again performed. The minimum direct current voltage applying period $t_{c1}$ has been set previously in the timer circuit 101. When the timer circuit 101 receives the signal from the starting discharge detecting unit 9, the circuit 101 begins to count the minimum direct current voltage applying period $t_{c1}$ at step S407. When the timer circuit 101 finishes counting the minimum direct current voltage applying period $t_{c1}$, the timer circuit 101 begins to count the additional direct current voltage applying period $t_{c2}$ sent from the period setting unit 14. As long as the timer circuit is counting the direct current voltage applying period $t_c$ ($=t_{c1}+t_{c2}$), the driving circuit 102 continues to keep the switching elements 81 and 84 continuously on and to keep the switching elements 82 and 83 continuously off. When the timer circuit 101 finishes counting the direct current voltage applying period $t_c$ at step S408, the timer circuit 101 sends a rectangular wave of frequency f2 (e.g. 400 Hz) to the driving circuit 102 at step S409. This rectangular wave is converted at the driving circuit 102 into two signals of about 50 percent duty ratio, the signals being generated to have dead time of several μ sec. These signals are sent in opposite phases to the switching elements 81–84 such that the switching elements 81, 84 and the switching elements 82, 83 are alternately switched.

Although power loss arises due to the switching elements 81–84, a rectangular alternating wave of a zero-to-peak voltage $V_o$ is applied to the discharge lamp 12. Therefore, the voltage $V_o$ is nearly equal to the voltage $V_L$ outputted from the DC stepping up unit 3.

The voltage detecting unit 5 sends a signal indicative of voltage $V_L$ to the power controlling unit 7. Upon receiving this signal, the power controlling unit 7 reads out the discharge lamp instruction current $I_s$ corresponding to the voltage $V_L$ from the discharge lamp voltage—discharge lamp instruction current characteristic which is set in the ROM 165 in the micro computer 16. Then, a voltage signal corresponding to this instruction current is outputted to the error amplifier 43.

On the other hand, the discharge lamp current $I_L$ which flows through the discharge lamp 12 is converted to a corresponding voltage by the resistor 6 and this voltage is inputted to the non-inverted input of the error amplifier 43 and is compared with a voltage inputted to the inverted input of the error amplifier 43 corresponding to a discharge lamp instruction current $I_s$ which the power controlling unit 7 indicates. At this time, the output voltage of the error amplifier 43 becomes higher than the output voltage of the error amplifier 42. Thus, after the starting discharge is performed, on-duty of the signal to be inputted to the switching element 34 is controlled by the PWM controlling unit 41 depending on the output voltage of the error amplifier 43.

When the voltage generated at the resistor 6 is higher than the output voltage of the power controlling unit 7, i.e., when the discharge lamp current $I_L$ which actually flows through the discharge lamp 12 is more than the discharge lamp instruction current $I_s$, the error amplifier 43 outputs a high voltage signal and the PWM controlling unit 41 decreases the on-duty of a signal to be inputted to the switching element 34 thereby the output voltage of the DC stepping up unit 3 decreases and the current flowing through the discharge lamp 12 also decreases.

On the other hand, when the voltage generated at the resistor 6 is lower than the output voltage of the power controlling unit 7, i.e., when the discharge lamp current $I_L$ is less than the discharge lamp instruction current $I_s$, the error amplifier 43 outputs a low voltage signal and the PWM controlling unit 41 increases the on-duty of the signal to be inputted to the switching element 34 thereby the output voltage of the DC stepping up unit 3 increases and a current which flows through the discharge lamp 12 increases. By repeating the above operations, the stepping up control unit 4 functions such that the amount of the discharge current $I_L$ flowing through the discharge lamp 12 is equal to the amount of the discharge lamp instruction current $I_s$. With this feedback system, the discharge lamp 12 quickly reaches the rated amount of light. When the lighting switch 2 is turned off, the discharge lamp 12 is extinguished at step S410.

Next, the principle of emitting light in the discharge lamp 12 will be briefly explained when the high voltage from several kV to ten and several kV is applied to the terminals of the discharge lamp 12, a discharge starts between the electrodes and a current flows between the electrodes. In the discharge lamp 12, the produced current activates the filled starting gas and an arc discharge of the starting gas starts. At this time, the voltage applied to the discharge lamp 12 increases from approx. 20 [V] and the lighting apparatus adjust the amount of light emitted from the discharge lamp 12 in a load status in such a way that the input power to the discharge lamp 12 gradually decreases as the voltage increases. When an input power is controlled, the internal temperature of the discharge lamp 12 rises quickly and mercury vapors thereby an arc discharge of mercury gas begins to take place. The center portion of the mercury arc reaches approx. 4500 K and the inside of the lighting tube become in a situation of higher temperature and higher pressure. Thus, metallic halide begins to vapor and metallic ion and halide ion are separated in the arc thereby metallic ion emits light in a spectrum peculiar to the metal.

After almost all metallic halide vapors, the arc light forms a final shape and reaches a final output. Then, the voltage applied to the discharge lamp 12 is saturated and the voltage is stabilized. At this time, the lighting apparatus keeps power supplied to the discharge lamp 12 at the rated power thereby the discharge lamp 12 emits stable light without flickering. Above explanation was made about the state of light emission of discharge lamp in the case of cold start. The gas temperature, the electrode temperature, and the gas pressure in the discharge lamp before discharge are low and the metal has not vapored yet.

In contrast, a hot start is a lighting in a state where the discharge lamp is still hot, i.e., in a state where temperature and pressure in the discharge lamp are high. In a hot start, gas temperature, electrode temperature, and gas pressure before discharge are high and mercury and other filled metal has vapored. Thus, the internal state of the discharge lamp before discharge in the case of a hot start is completely different from that in the case of a cold start. Considering the aging of the discharge lamp and so forth, the discharge lamp has various states other than two states of a hot start and a cold start, and the internal state of the discharge lamp before discharge is also various. Thus, in order to supply the optimum power to the discharge lamp during the direct current voltage applying period, the power must be determined depending on various internal states of the discharge lamp before discharge. If the direct current voltage applying period is constant, there are a case where the discharge lamp is given a damage due to overpower, and a case where the lamp is extinguished or flickers due to lack of power. Thus, in order to supply the optimum power to the discharge lamp during the direct current voltage applying period, it is important to change the direct current voltage applying period depending on the internal state of the discharge lamp. In doing so, the internal state of the discharge lamp must be known. However, it is difficult to measure the temperature or pressure of the discharge lamp directly. Therefore, by measuring the tube wall temperature of the discharge lamp, the temperature inside the lighting equipment, the minimum output voltage from the DC stepping up unit after dielectric breakdown, the change rate of voltage of the DC stepping up unit, the non-lighting period, the internal temperature of the discharge lamp before discharge is inferred.

When the discharge lamp is lit, the internal temperature begins to gradually increase and the temperature is transmitted through the quartz which forms the tube wall of the discharge lamp. In this case, although a degree of temperature increase of the gas filled in the discharge lamp is slightly different from that of the quartz, the trend of the change is considered to be similar.

When the discharge lamp is extinguished, the internal temperature begins to gradually decrease and the tube wall temperature also begins to decrease in a way similar to the internal temperature, In this case, although a degree of temperature decrease of the gas filled in the discharge lamp is slightly different from that of the quartz, it is considered that, after the discharge lamp is extinguished, the internal temperature of the discharge lamp is considered to be nearly equal to the tube wall temperature. Thus, the internal temperature of the discharge lamp before discharge is inferred by measuring a tube wall temperature of the discharge lamp before discharge.

As explained above, as the internal temperature of the discharge lamp changes, the temperature of the tube wall changes. In the case where the discharge lamp is installed in the lighting equipment and the equipment is tight-sealed, when the discharge lamp is lit, the internal temperature begins to increase and the heat is transmitted through the quartz of the tube wall and the temperature of the air filled in the lighting equipment begins to increase. When the discharge lamp is extinguished, the internal temperature decreases and thereby the tube wall temperature and the temperature inside the lighting equipment also decreases. At this time, although the temperature change rate of the gas filled in the discharge lamp is different from the temperature change rate of the air filled in the lighting equipment, the temperature of the air changes corresponding to the change of the internal temperature. The table is previously prepared which shows the relationship between temperatures of air in the lighting equipment and temperatures of the tube wall by measuring these temperatures. Because the tube wall temperature is nearly equal to the internal temperature, the internal temperature of the discharge lamp can be obtained by measuring a temperature of the air filled in the lighting equipment and by referring to the table. Therefore, internal temperature of the discharge lamp before discharge is inferred by measuring temperature of the air filled in the discharge lamp. The detailed explanation of this operation will be made in the Embodiment 2 of the invention.

Figure 7:
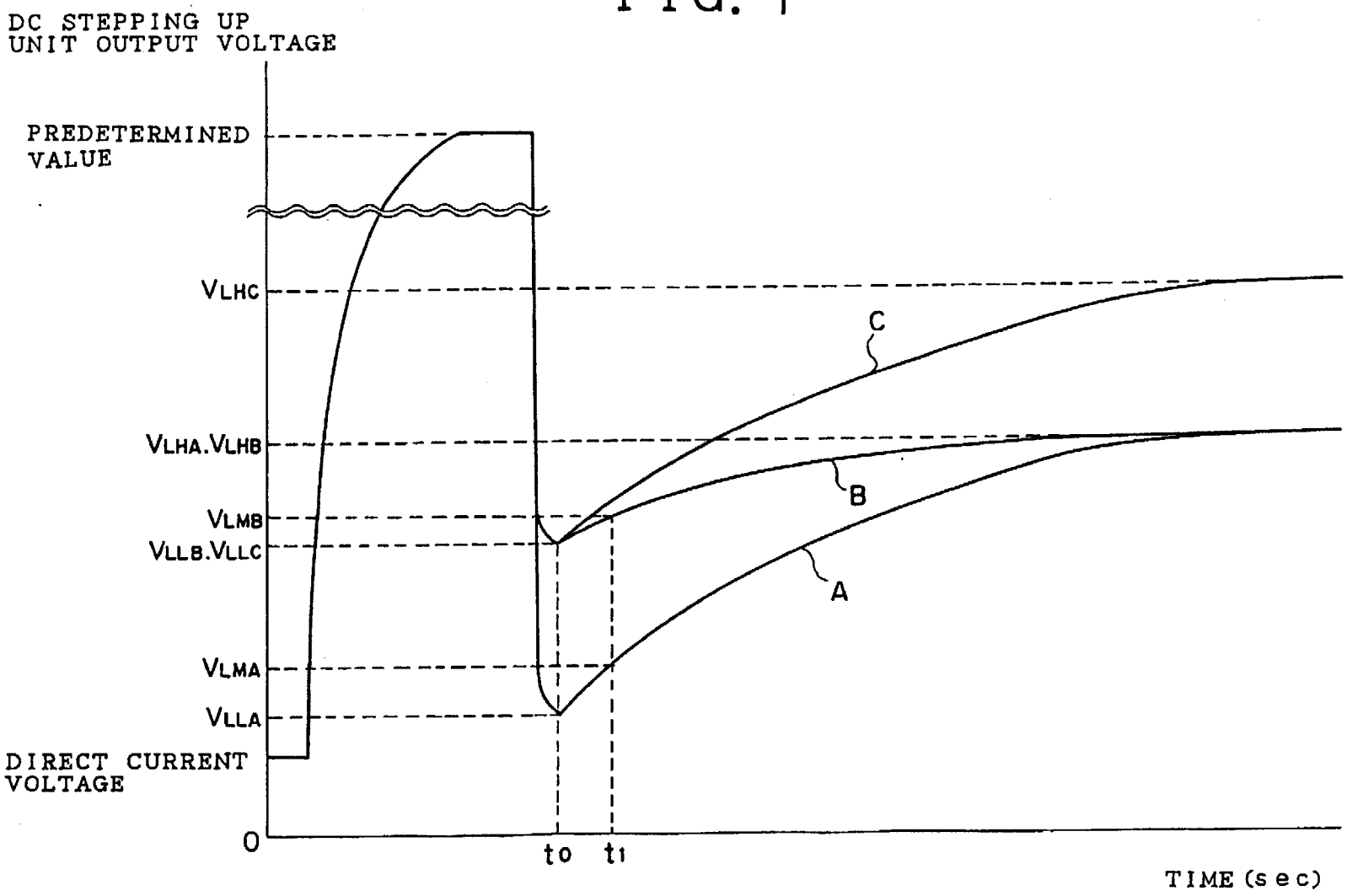
FIG. 7 is a graph showing the relationship between voltage outputted from the DC stepping up unit and elapsing time.

FIG. 7 is a graph showing the relationship between the output voltage of the DC stepping up unit 3 and time when starting discharge takes place. In this figure, curves A and C indicate voltage outputted from the DC stepping up unit 3 in the case of a cold start, curve B indicates voltage outputted from the DC stepping unit 3 in the case of a hot start. The voltage $V_{LHA}$ in the case where the lamp is lit at the rated power in the curve A is equal to the voltage $V_{LHB}$ in the case where the lamp is lit at the rated power in the curve B and the voltage $V_{LHC}$ in the case where the lamp is lit at the rated power in the curve C is higher than the voltage $V_{LHA}$. The output voltage of the DC stepping up unit 3 drops once after dielectric breakdown and, after that, rises to the voltage at the rated power lighting. As depicted by the curves A and B, if output voltages of the DC stepping up unit 3 at the rated power lighting are the same, the minimum voltage $V_{LLA}$ outputted from the DC stepping up unit 3 after dielectric breakdown is different from the minimum voltage $V_{LLB}$. However, as depicted by the curves B and C, even if the minimum voltage $V_{LLB}$ is the same as the minimum voltage $V_{LLC}$, the curve B indicates a hot start and the curve C indicates a cold start. Therefore it is not always true that a cold start takes place if the minimum voltage outputted from the DC stepping up unit 3 is low and a hot start takes place if the minimum voltage outputted from the DC stepping unit 3 is high. Using the minimum voltage $V_{LL}$ outputted from the DC stepping up unit 3 in the case of a cold start, the output voltage $V_{LH}$ at the rated power lighting, and the minimum voltage $V_{LX}$ from the DC stepping up unit 3 at each lighting, a lighting discriminating number $\alpha$ is calculated as follows:

$$\alpha=(V_{LX}-V_{LL})/(V_{LH}-V_{LL}).$$

The internal temperature in the case where the discharge lamp is on is calculated depending on a lighting discriminating number $\alpha$. The detailed explanation of the above operation will be made in the Embodiment 3.

Voltage change rates $\eta_A$ and $\eta_B$ of the curves A and B at times $t_0$ and $t_1$ after the output voltage from the DC stepping unit 3 becomes minimum are expressed as follows:

$$\eta_A=(V_{LMA}-V_{LLA})/(t_1-t_0),$$

$$\eta_B=(V_{LMB}-V_{LLB})/(t_1-t_0).$$

As clearly shown in FIG. 7, it is known that the voltage change rate $\eta_A$ is greater than the voltage change rate $\eta_B$. Therefore, if a change rate of the voltage outputted from the DC stepping up unit 3 is large, a cold start takes place and if a change rate of the change rate is small, a hot start takes place. Therefore, by calculating a voltage change rate at the arbitrary two points in time after the voltage from the DC stepping up unit 3 becomes minimum, an internal temperature of the discharge lamp can be inferred. The detailed explanation of the above operation will be made in the Embodiment 4.

Figure 8:
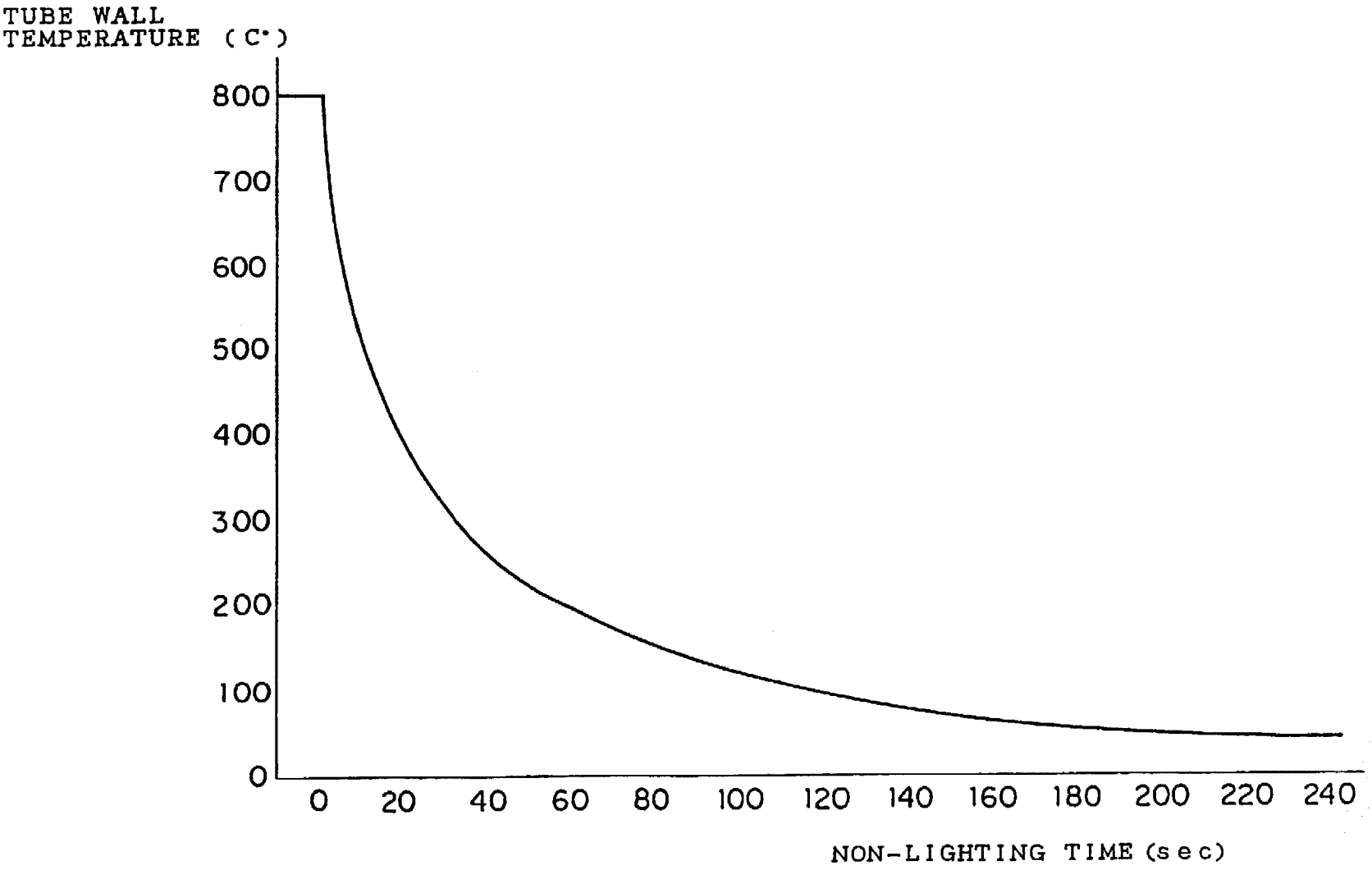
FIG. 8 is a graph showing the relationship between tube wall temperature after extinguishment of the lamp and elapsing time.

FIG. 8 is a graph showing the relationship between the non-lighting time and tube wall temperature in the case where the discharge lamp is lit at the atmosphere temperature 25° C. and the lamp is extinguished after the rated power is supplied to the lamp. As shown in FIG. 8, a tube wall temperature decreases as time elapses. Thus, it is known that, if the non-lighting period until the discharge lamp is lit is long, the wall temperature at the time of lighting discharge lamp is low, and if the non-lighting period is short, the tube temperature is high. The table is previously prepared which shows the non-lighting time period until the lamp is lit and the tube wall temperature. Then, the internal temperature of the discharge lamp can be inferred by measuring non-lighting time period until the lamp is lit and by referring to the table. A detailed explanation of the above operation will be made in the embodiment 5.

Embodiment 2

Next, the second embodiment of this invention will be explained with reference to FIG. 9. The same reference numerals are attached to the same or similar elements as those of FIG. 1 and duplicate explanations are omitted.

Figure 9:
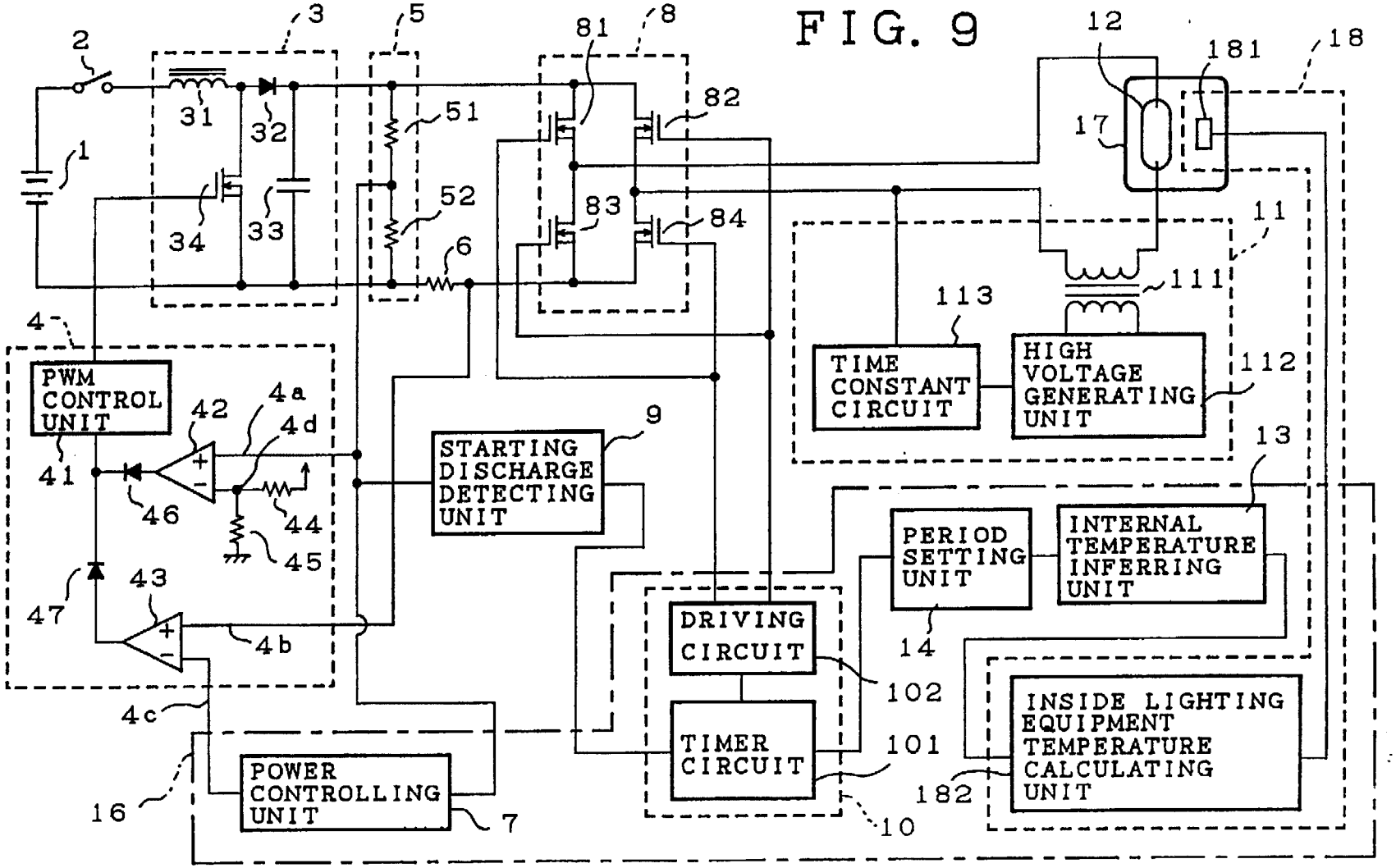
FIG. 9 is a schematic drawing showing a structure of the embodiment 2 of the invention.
Figure 10:
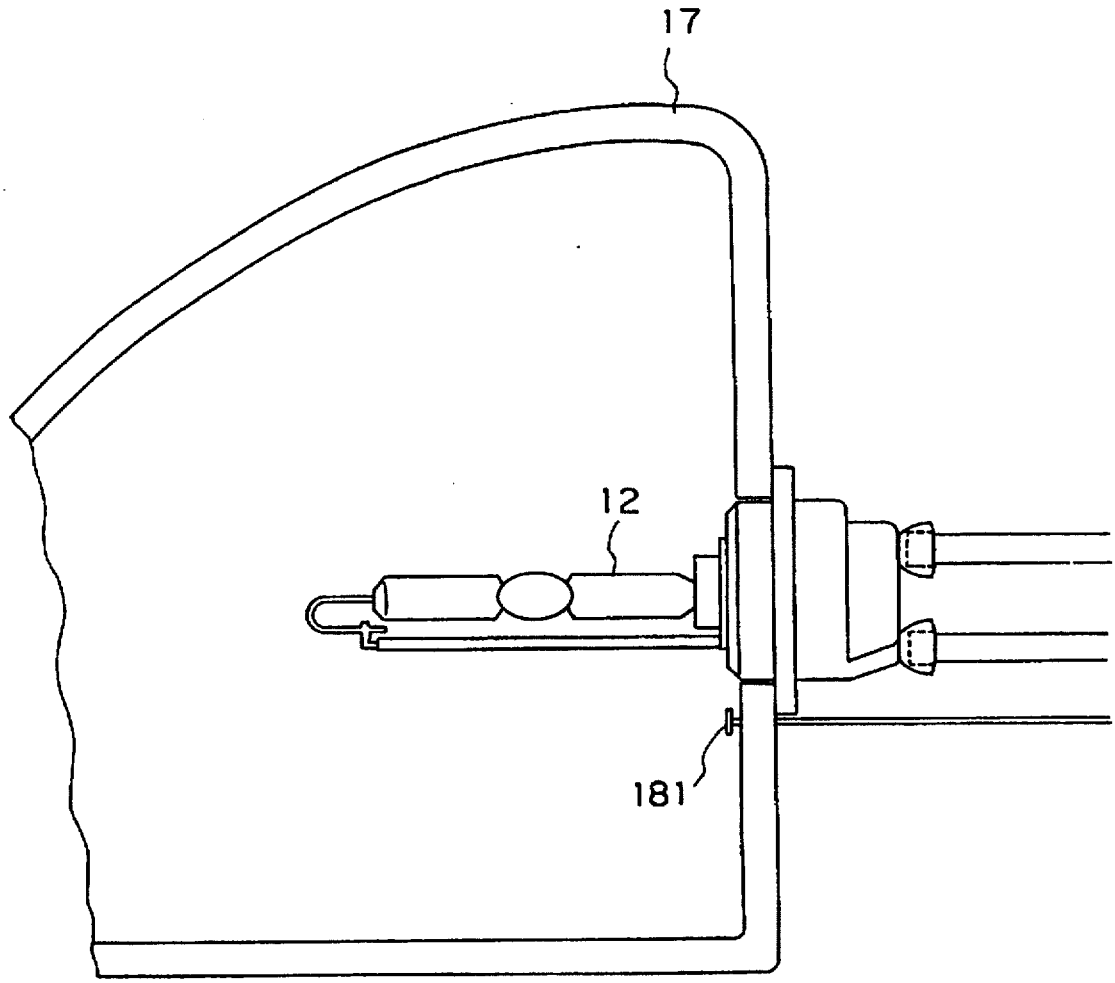
FIG. 10 is a thermo-couple provided in the lighting equipment.

In FIG. 9, reference numeral 17 denotes a lighting equipment which includes the discharge lamp 12, reference numeral 18 denotes an inside lighting equipment temperature measuring unit which measures a temperature inside the lighting equipment 17. The inside lighting equipment temperature measuring unit 18 is constituted of the thermocouple 181 which is inserted into the lighting equipment 17 and an inside lighting equipment temperature calculation unit 182 which calculates out the temperature on the basis of voltage generated at the thermo-couple 181 as shown in FIG. 10.

Figure 11:
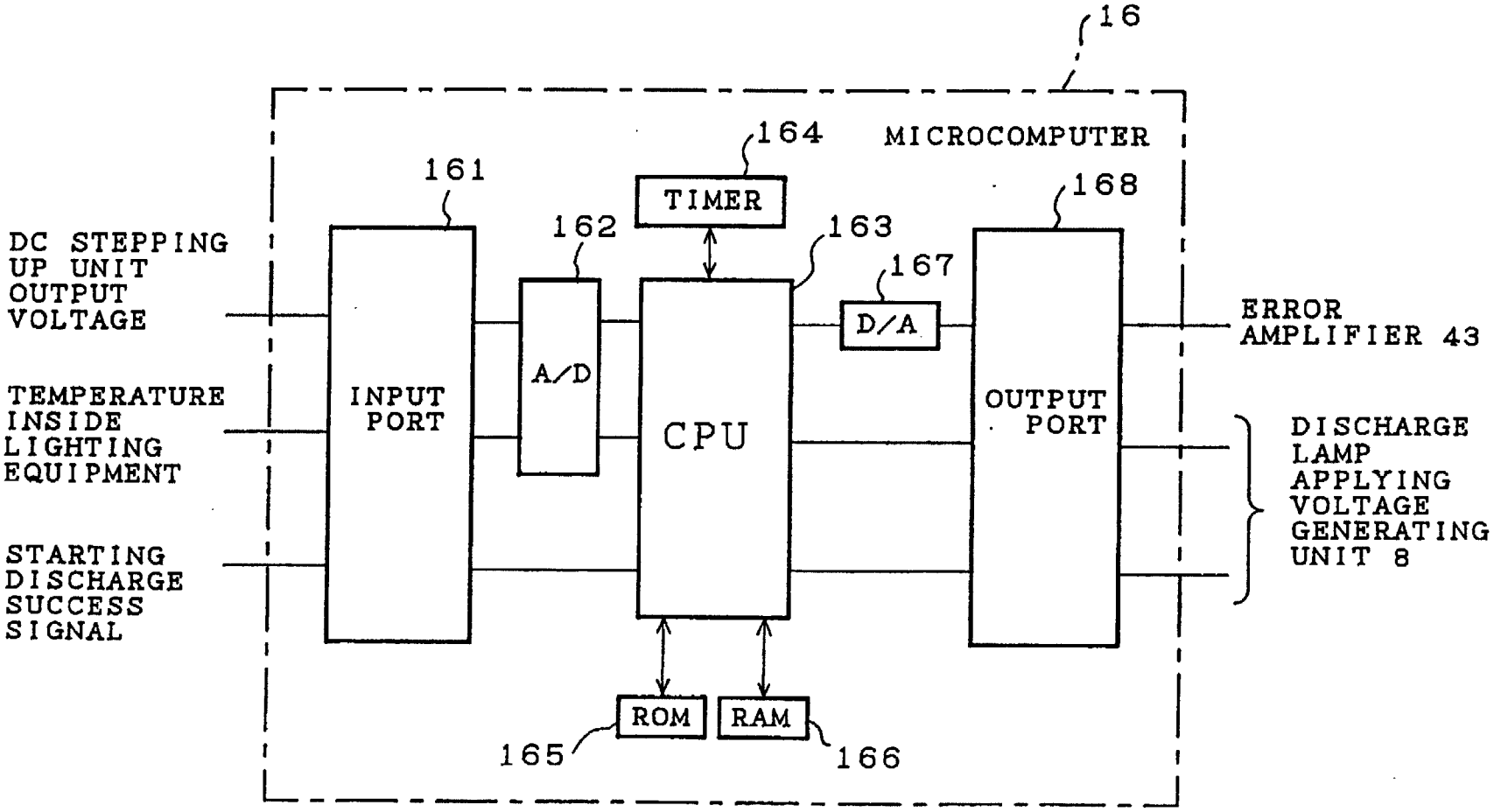
FIG. 11 is a block diagram in which a part of the elements of the embodiment 2 is constituted by a microcomputer.

FIG. 11 is a block diagram in which the power controlling unit 7, the driver unit 10, the internal temperature inferring unit 13, the period setting unit 14 and the inside lighting equipment temperature calculation unit 181 are realized by using microcomputer 16. The same reference numerals are attached to the same or similar portions as those of FIG. 3 and duplicate explanations are omitted.

Figure 12:
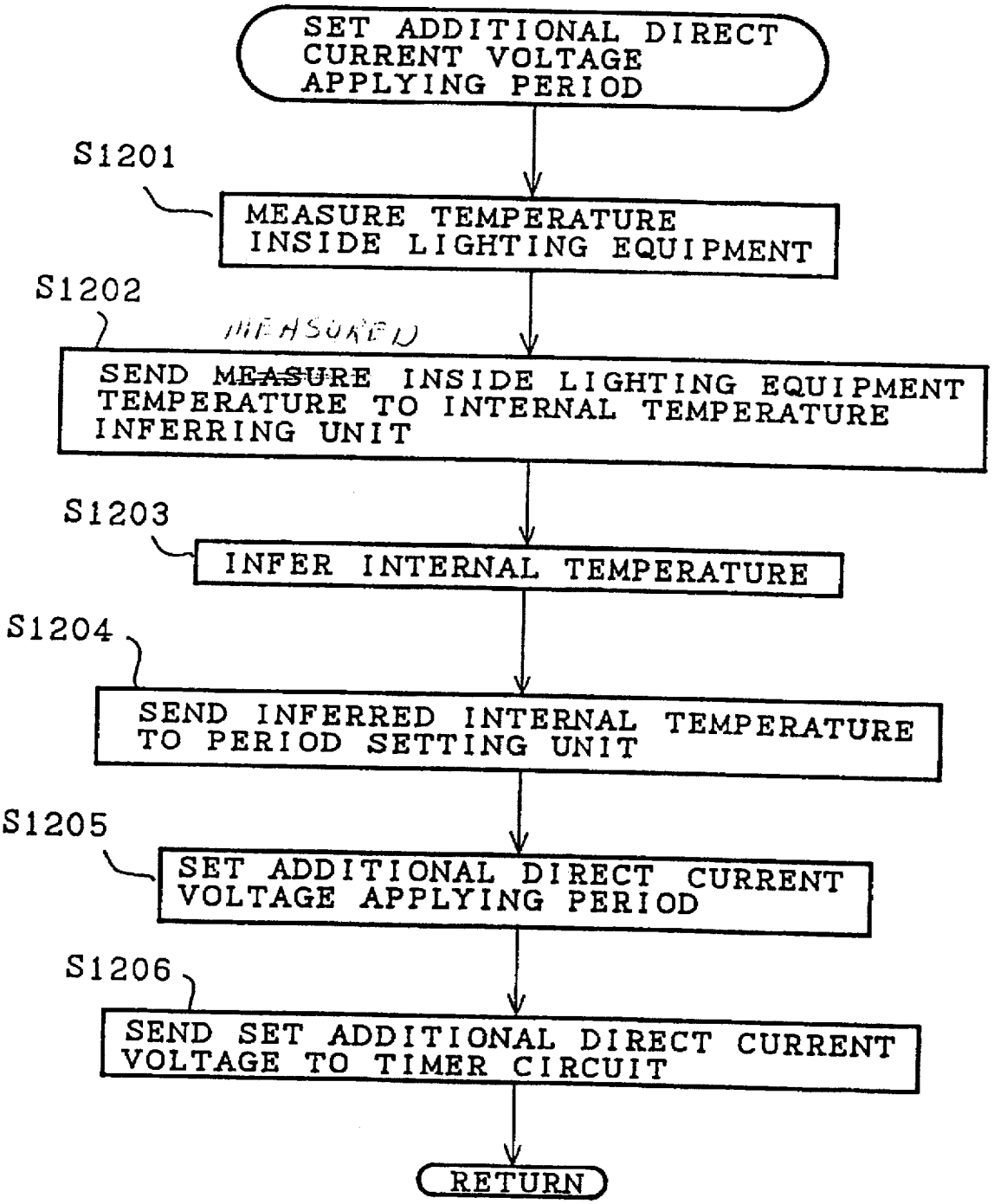
FIG. 12 is a flowchart showing the operations of embodiment 2.

In this embodiment, because all the operations other than the additional direct current voltage applying period setting operation of FIG. 4 are the same as those of embodiment 1, only the additional direct current voltage applying period setting operation will be explained with reference to the flowchart of FIG. 12 and the explanation of the other operations are omitted.

When the lighting switch 2 is turned on, the inside lighting equipment temperature measuring unit 18 measures a temperature inside the lighting equipment 17 before discharge at step S1201. A temperature inside the lighting equipment 17 indirectly indicates internal temperature of the discharge lamp 12 because a temperature inside the lighting equipment 17 changes corresponding to a change in the internal temperature of the discharge lamp 12. Therefore, it can be inferred that a cold start takes place when temperature inside the lighting equipment is low and that a hot start takes place when the temperature inside the lighting equipment is hot. Thus, internal temperature of discharge lamp 12 before discharge can be inferred by measuring a temperature inside the lighting equipment 17. The inside lighting equipment temperature measuring unit 18 sends data indicative of the temperature inside the lighting equipment measured at step S1201 to the internal temperature inferring unit 13 at step S1202. A table of inside lighting equipment-internal temperature characteristic is previously stored in the ROM 165 of the microcomputer 16, which shows the relationship between the temperature inside the lighting equipment and the corresponding internal temperatures. When the inside lighting equipment temperature measuring unit 18 sends data indicative of temperature inside the lighting equipment, the corresponding internal temperature of the discharge lamp 12 is inferred, referring to this table at step S1203. The operations of setting direct current voltage applying period (from step S1204 to step S1206) are the same as those of the embodiment 1, therefore, the explanation thereof is omitted.

Embodiment 3

Next, the third embodiment of the invention will be explained with reference to FIG. 13. The same reference numerals are attached to the same or similar elements as those of FIG. 1 and duplicate explanations are omitted.

Figure 13:
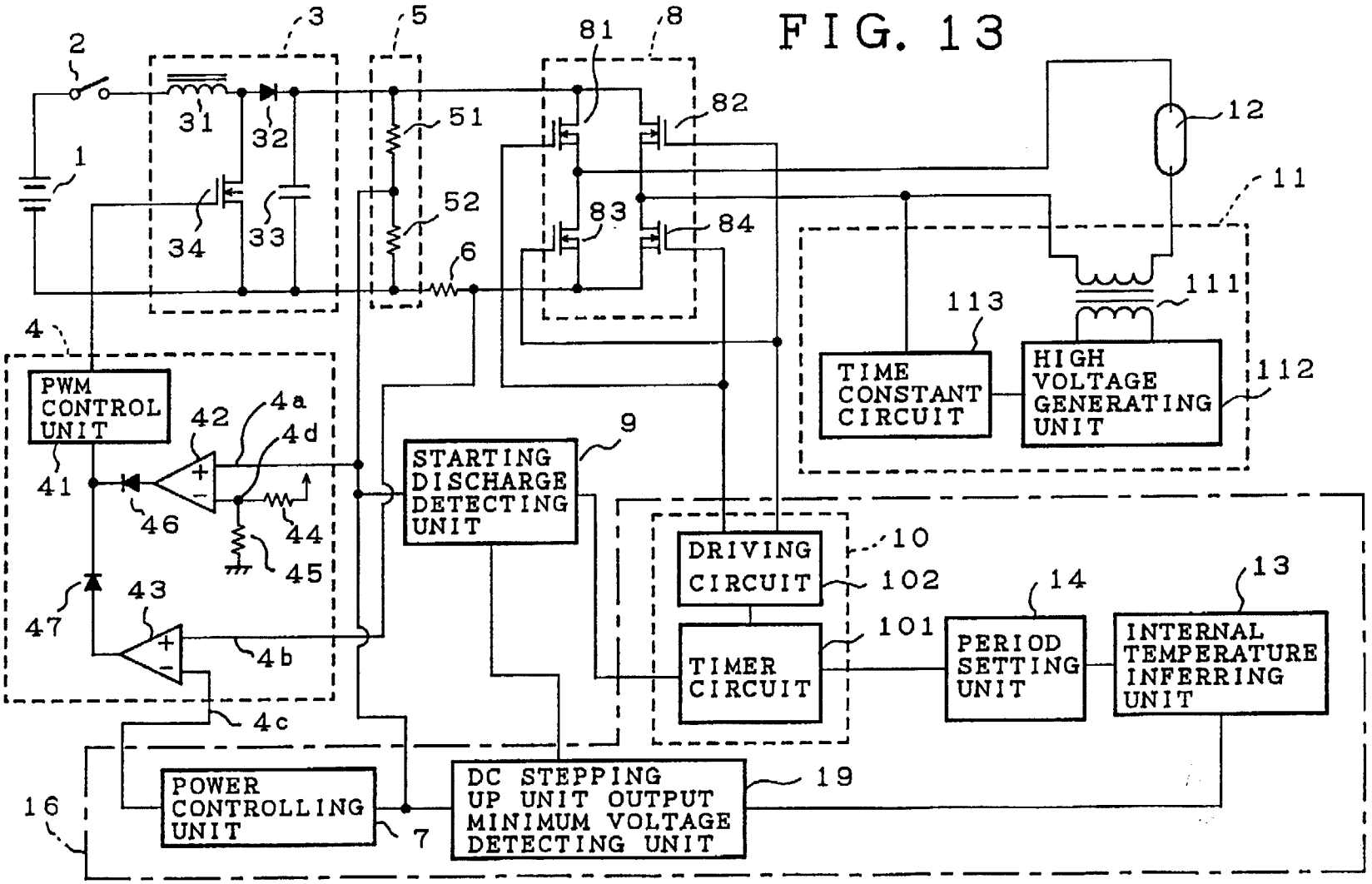
FIG. 13 is a schematic drawing showing the structure of the embodiment 3 of the invention.

In FIG. 13, reference numeral 19 denotes a DC stepping up unit output minimum voltage measuring unit which stores the minimum output voltage from the DC stepping up unit 3 after discharge is started in a cold start and the output voltage at the rated power lighting of discharge lamp 12. The DC stepping up unit output minimum voltage measuring unit 19 further measures the minimum voltage outputted from the DC stepping up unit 3 each time the discharge lamp 12 is lit.

Figure 14:
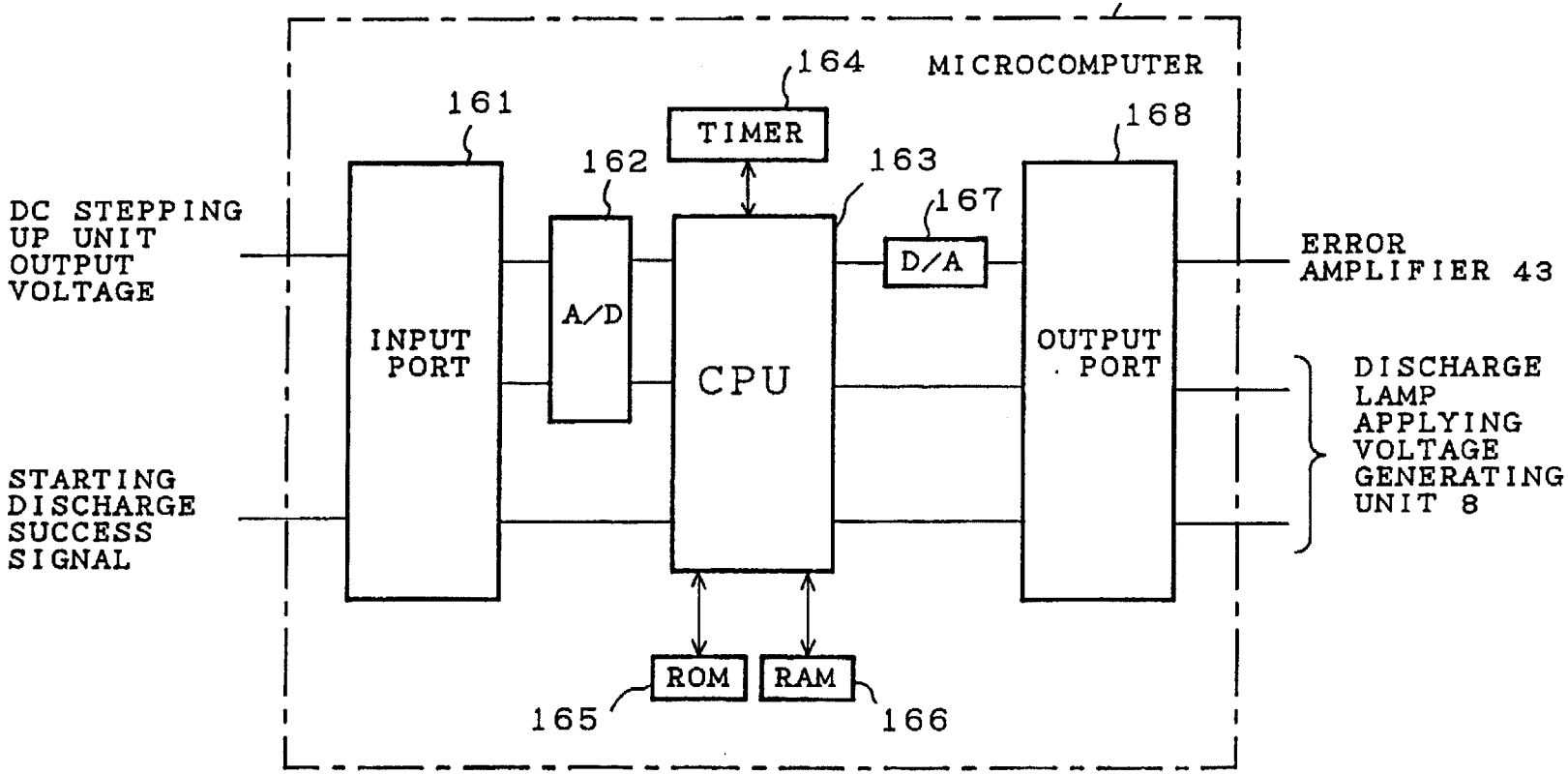
FIG. 14 is a block diagram in which a part of the elements of the embodiment 3 is constituted by a microcomputer.

FIG. 14 is a block diagram in which the power controlling unit 7, the driver unit 10, the internal temperature inferring unit 13, the period setting unit 14 and the DC stepping up output minimum voltage measuring unit 19 are realized by using microcomputer 16.

Figure 15:
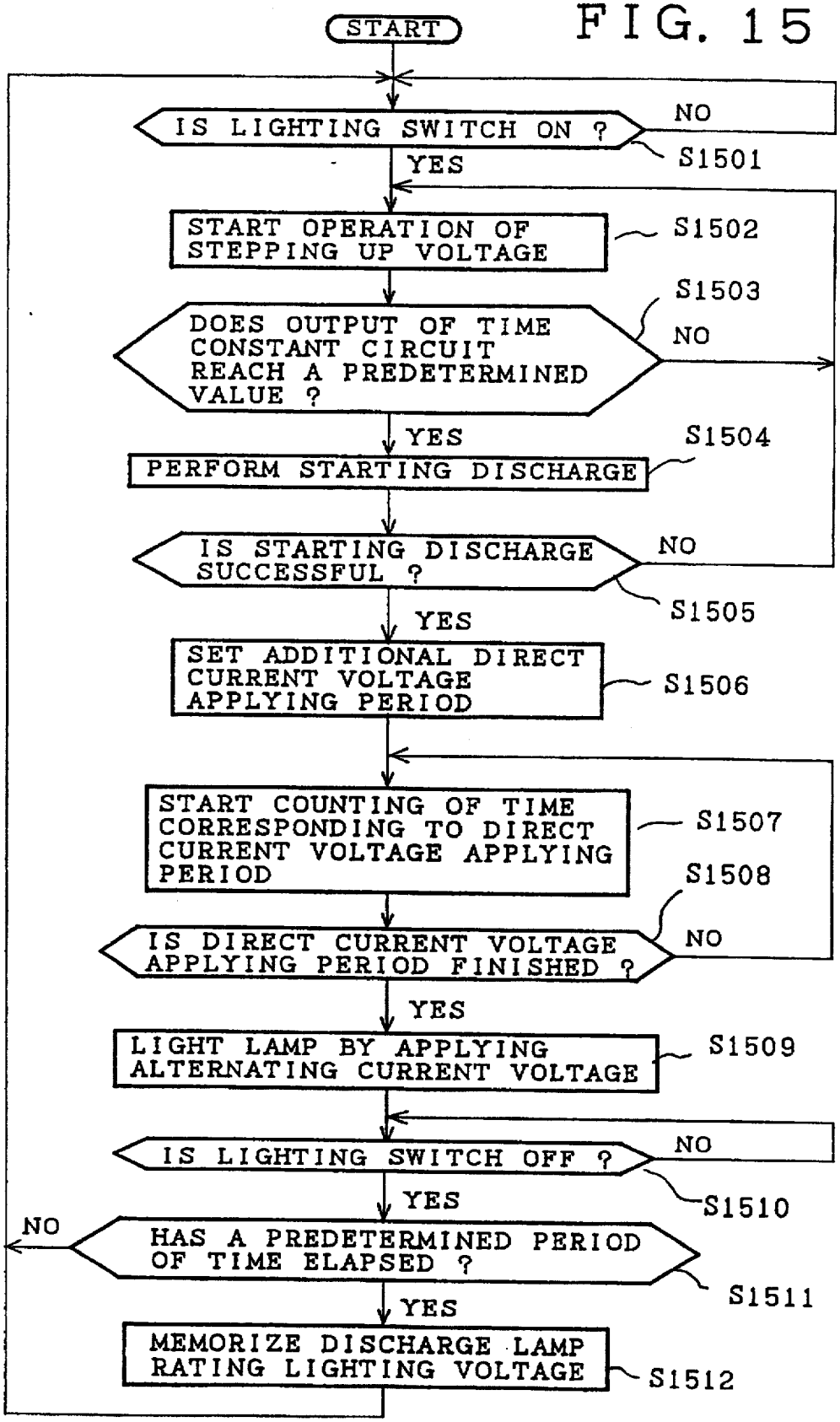
FIG. 15 is a flowchart showing the general operation of the embodiment 3.
Figure 16:
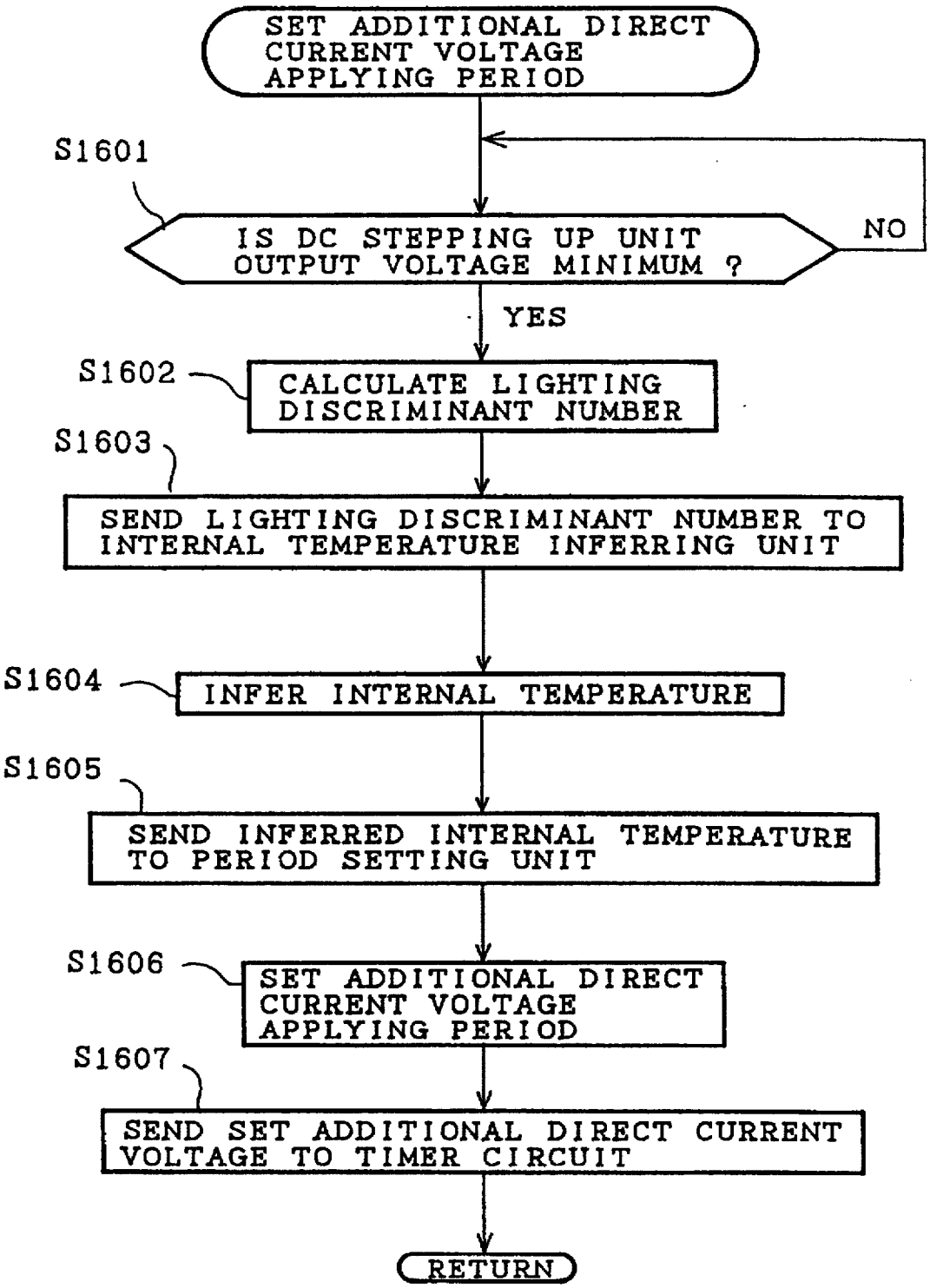
FIG. 16 is a flowchart showing the operation of setting an additional direct current voltage applying period in embodiment 3.

FIG. 15 is a flowchart showing the operations of this embodiment. In this embodiment, because all the operations other than the additional direct current voltage applying period setting operation and the operation of storing the DC stepping unit output voltage at rated power lighting are the same as those of embodiment 1, only the additional direct current voltage applying period setting operation will be explained with reference to the flowchart of FIG. 16 and the explanation of the other operations are omitted.

Let the minimum voltage outputted from the DC stepping up unit 3 when a cold start takes place be $V_{LL}$, the voltage outputted from the DC stepping up unit 3 at rated power lighting be $V_{LH}$, the minimum voltage outputted from the DC stepping up unit 3 be $V_{LX}$. A lighting discriminant number a is defined as follows:

$$\alpha=(V_{LX}-V_{LL})/(V_{LH}-V_{LL})$$

If a cold start takes place, $V_{LX}\approx V_{LL}$ and therefore $\alpha\approx 0$. On the other hand, if a hot start takes place, $V_{LX}\approx V_{LH}$ and therefore $\alpha\approx 1$. Namely, the closer the number $\alpha$ comes to 0, the lower the internal temperature of the discharge lamp 12 is and the closer the number comes to 1, the higher the internal temperature of the discharge lamp 12 is. Therefore, the internal temperature of the discharge lamp 12 can be inferred by previously storing the voltages $V_{LL}$ and $V_{LH}$ and by measuring minimum voltage $V_{LX}$ each time the discharge lamp is lit.

The minimum voltage measuring unit 19 judges if the output voltage $V_L$ outputted from the DC stepping up unit 3 becomes minimum at step S1601. If the output voltage $V_L$ becomes minimum, this minimum voltage $V_{LX}$ is memorized and a lighting discriminant number $\alpha$ is calculated using the above equation at step S1602. The minimum voltage measuring unit 19 sends the calculated lighting discriminant number $\alpha$ to the internal temperature inferring unit 13 at step S1603. A table of lighting discriminant number—internal temperature characteristic is previously stored in the ROM 165 of the microcomputer 16, which shows the relationship between lighting discriminant numbers and corresponding internal temperatures of the discharge lamp 12. When the internal temperature inferring unit 13 receives a lighting discriminant number α sent from the minimum voltage measuring unit 19, the unit 13 determines a internal temperature of the discharge lamp 12 before discharge, referring to the table of lighting discriminant number—internal temperature characteristic at step S1604. The operations of setting direct current voltage applying period on the basis of the internal temperature of the discharge lamp 12 before discharge is the same as those of the embodiment 1 and duplicate explanations for these operations are omitted.

When the lighting switch 2 is turned off at step S1511, the minimum voltage measuring unit 19 judges if the voltage $V_L$ from the DC stepping up unit 3 reaches the voltage outputted from DC stepping up unit 3 at rated power lighting at step S1511. If the voltage $V_L$ reaches the voltage in lighting at rated power, the minimum voltage measuring unit 19 memorizes the voltage $V_L$ as the voltage $V_{LH}$. A time period required for the voltage $V_L$ to reach the voltage in lighting at rated power lighting is previously worked out by experiments. Whether the voltage $V_L$ reaches the voltage in lighting at rated power is judged by checking if the time period elapsed after the lighting switch 2 is turned off.

Embodiment 4

Next, the fourth embodiment of the invention will be explained with reference to FIG. 17. The same reference numerals are attached to the same or similar elements as those of FIG. 1 and duplicate explanations are omitted.

Figure 17:
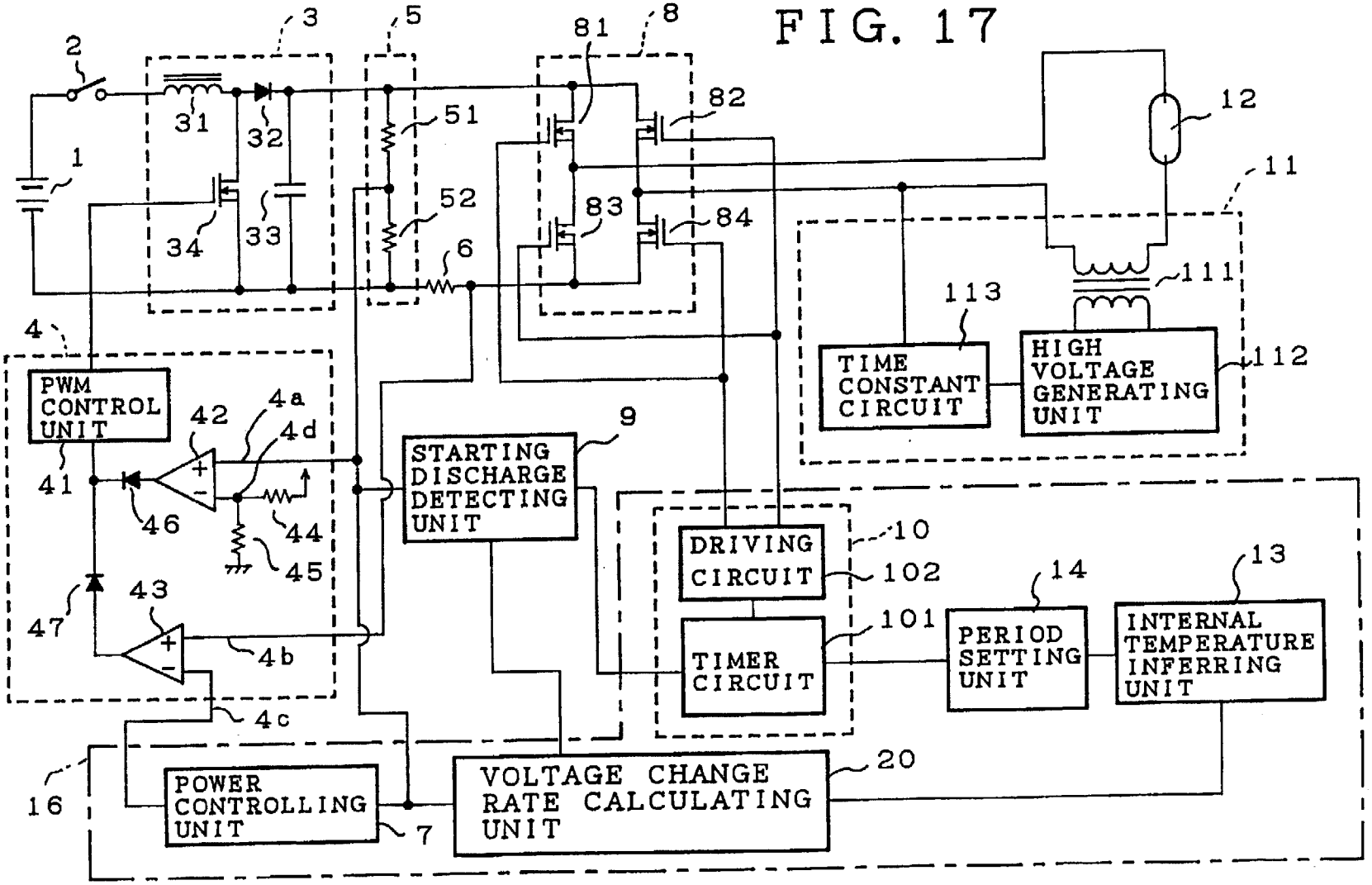
FIG. 17 is a schematic drawing showing the structure of the embodiment 4 of the invention.

In FIG. 17, reference numeral 20 denotes a voltage change rate calculating unit which calculates a voltage change rate at two predetermined points in time after the time when the lighting switch 2 is turned on, the discharge is started, and output voltage becomes minimum.

Figure 18:
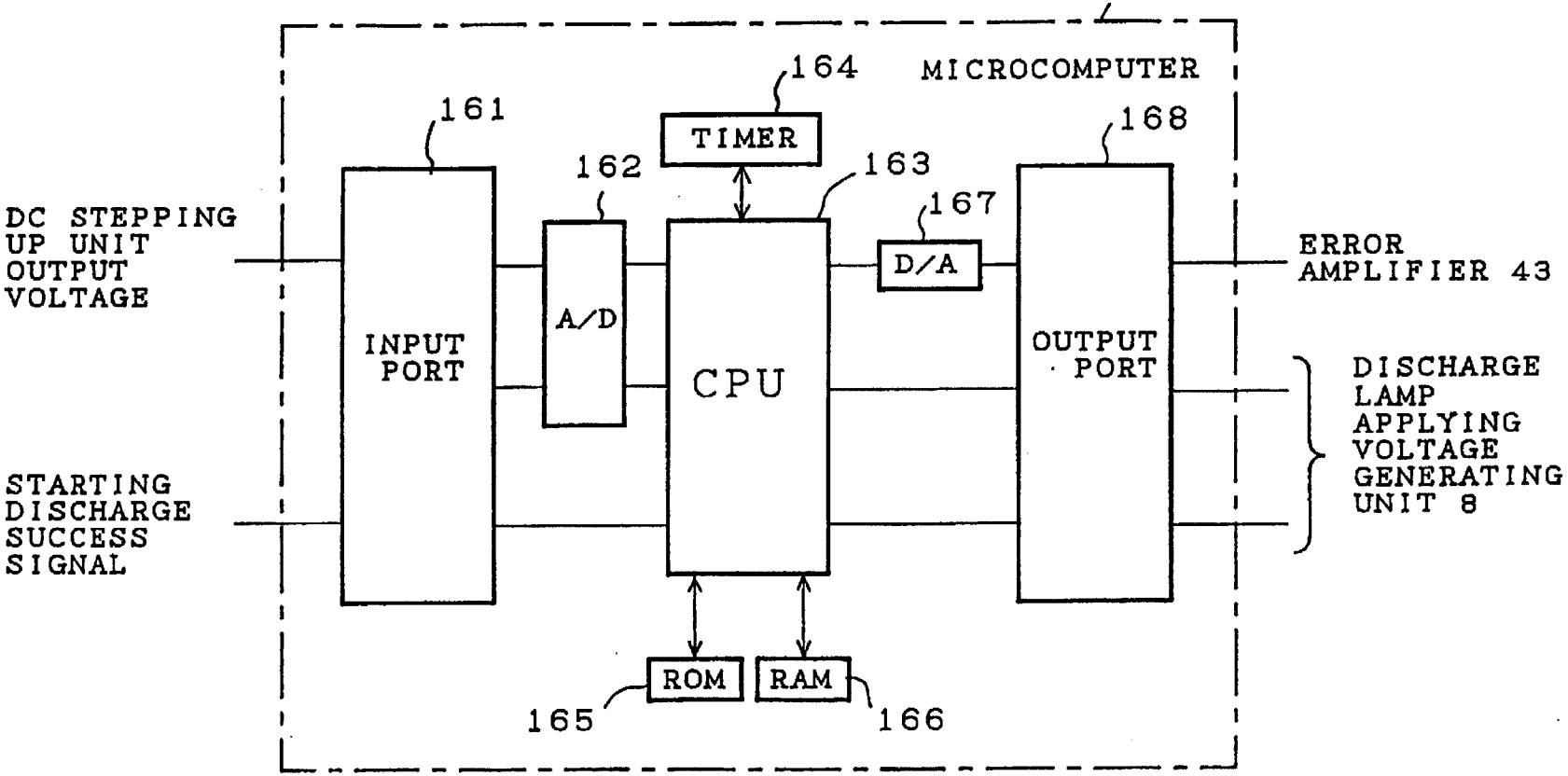
FIG. 18 is a block diagram in which a part of the elements of the embodiment 4 is constituted by a microcomputer.

FIG. 18 is a block diagram in which the power controlling unit 7, the driver unit 10, the internal temperature inferring unit 13, the period setting unit 14 and the voltage change rate calculating unit 20 are realized by using microcomputer 16. The same reference numerals are attached to the same or similar elements as those of FIG. 3 and duplicate explanations are omitted.

Figure 19:
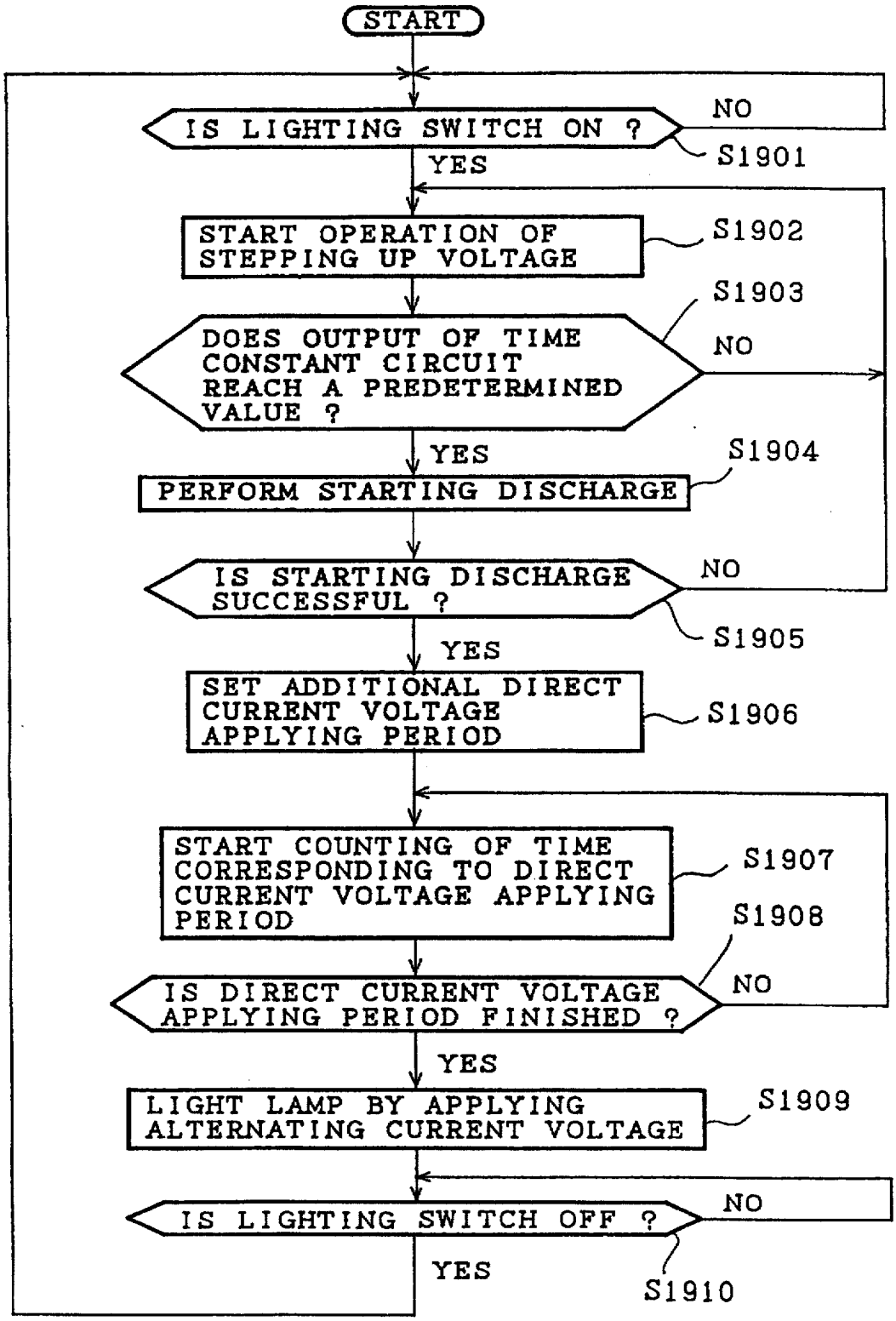
FIG. 19 is a flowchart showing the general operation of the embodiment 4.
Figure 20:
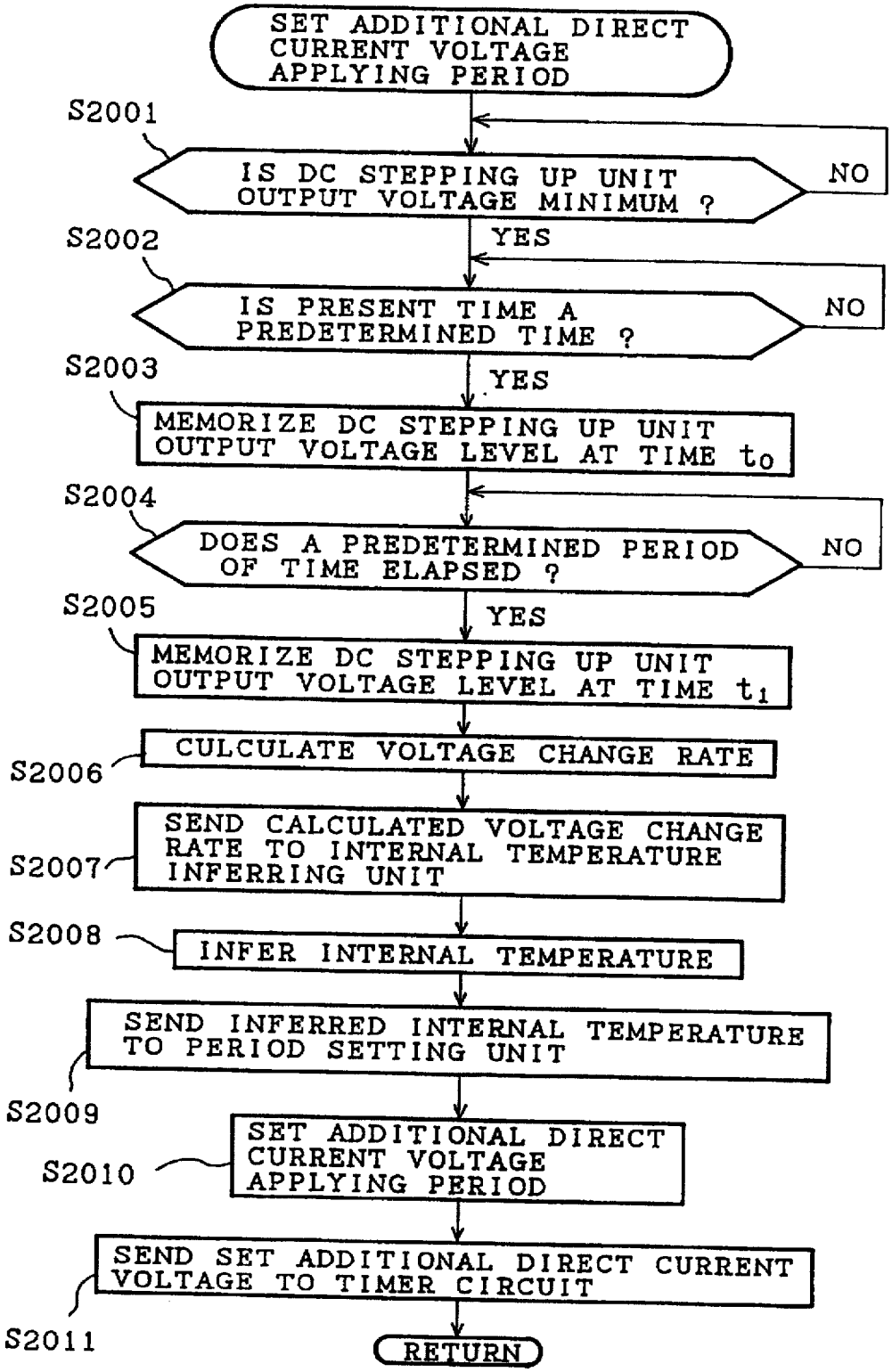
FIG. 20 is a flowchart showing the operation of setting a additional direct current voltage applying period in embodiment 4.

The operations of this embodiment will be explained with reference to the flowchart of FIG. 19. Because the all operations other than the operation of setting an additional direct current voltage applying period are the same as those of the embodiment 1, only the operation of setting an additional direct current applying period will be explained with reference to the flowchart of FIG. 20 and the explanations of the other operations are omitted.

An output voltage from the DC stepping up unit 3 drops once after dielectric breakdown and increases as time elapses to the voltage in lighting at rated power. The change rate of the output voltage from the DC stepping up unit in view of time is high when the output voltage is low and the change rate becomes lower as the output voltage comes nearer the output voltage in lighting at rated power. When a cold start takes place, the output voltage from the DC stepping up unit 3 drops to a great degree after dielectric breakdown takes place and the voltage change rate is high. On the other hand, when a hot start takes place, the voltage from the unit 3 is near the voltage in lighting at rated power and the voltage change rate is low. That is, it is inferred that when the voltage change rate from the DC stepping up unit 3 after the time when the lamp is lit is high, a cold start takes place and the internal temperature of the discharge lamp 12 before discharge is low, and when the voltage change rate is low, a hot start takes place and the internal temperature is hot.

The voltage change rate calculating unit 20 judges if the voltage $V_L$ from the DC stepping unit 3 becomes minimum at step S2001. If so, the calculating unit 20 judges if the present time reaches a predetermined time at step S2002. If the present time reaches the predetermined time, the voltage change rate calculating unit 20 memorizes the voltage VL at this time as voltage $V_0$ of time $t_0$ at step S2003. Whether a predetermined time period has been elapsed from the time $t_0$ is judged at step S2004. If the predetermined time has been elapsed, the voltage change rate calculating unit 20 memorizes the voltage $V_L$ at this time as the voltage $V_1$ of time $t_1$ at step S2005. Then, a change rate of a voltage outputted from the DC stepping up unit 3 is worked out using the following equation at step S2006.

$$\eta=(V_1-V_0)/(V_1-V_0)$$

The voltage change rate calculating unit 20 sends the calculated voltage change rate to the internal temperature inferring unit 13 at step S2007. A table of voltage change rate—internal temperature characteristic is previously stored in the ROM 165 of the microcomputer 16, which shows relationship between voltage from the DC stepping up unit 3 and corresponding internal temperature of the discharge lamp 12. When the voltage change rate calculating unit 20 sends out the voltage change rate η, the internal temperature is determined by referring to the table of voltage change rate—internal temperature characteristic at step S2008. The operations of setting direct current voltage applying period on the basis of the internal temperature of the discharge lamp 12 before discharge is the same as those of the embodiment 1 and duplicate explanations for these operations are omitted.

Embodiment 5

Next, the fifth embodiment of the invention will be explained with reference to FIG. 21. The same reference numerals are attached to the same or similar elements as those of FIG. 1 and duplicate explanations are omitted.

Figure 21:
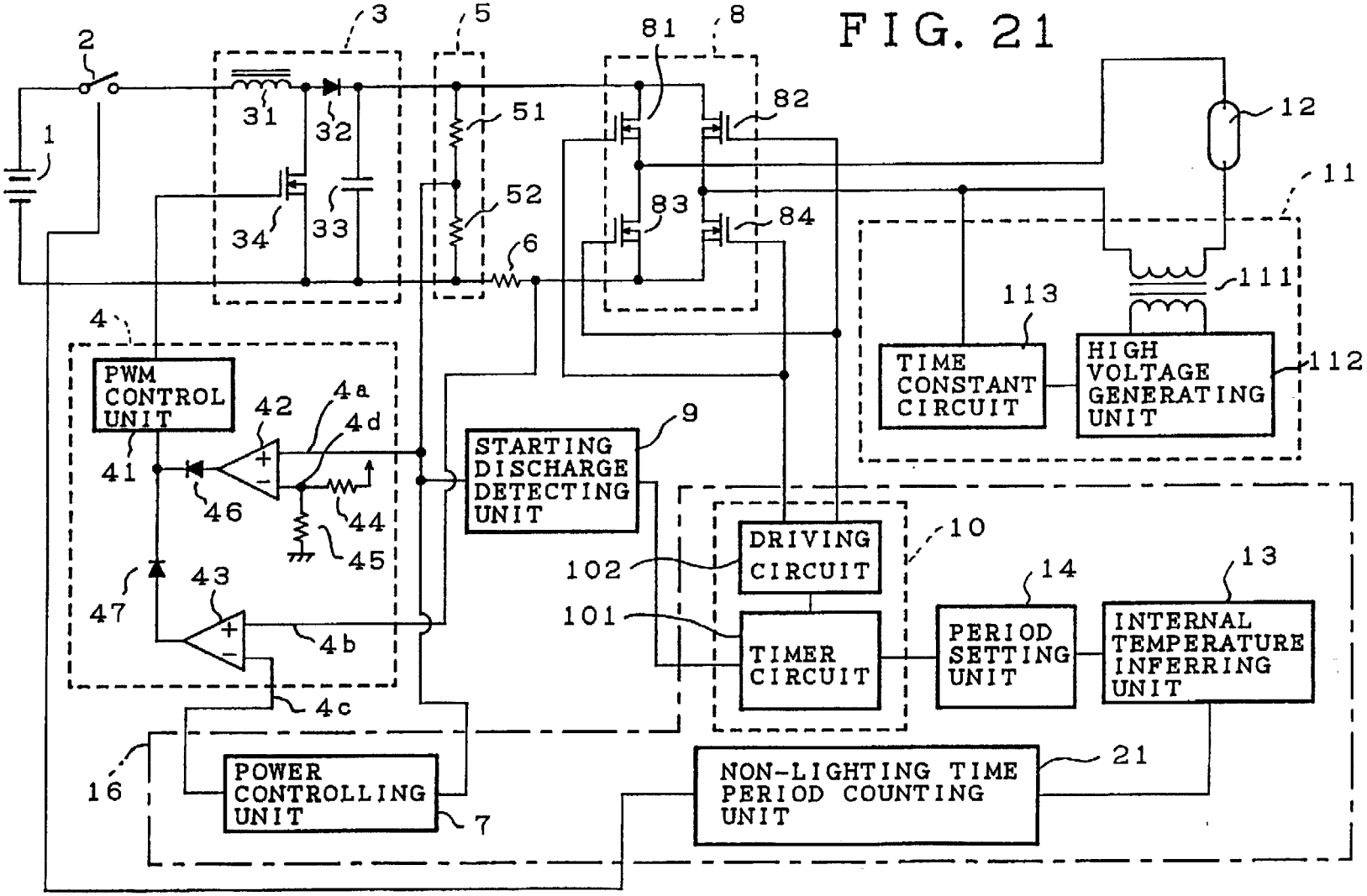
FIG. 21 is a schematic drawing showing the structure of the embodiment 5 of the invention.

In FIG. 21, reference numeral 21 denotes non-lighting time counting unit which counts the non-lighting time period of the discharge lamp 12 from the time when the lighting switch 2 is turned off to the time when the lighting switch 2 is turned on next.

Figure 22:
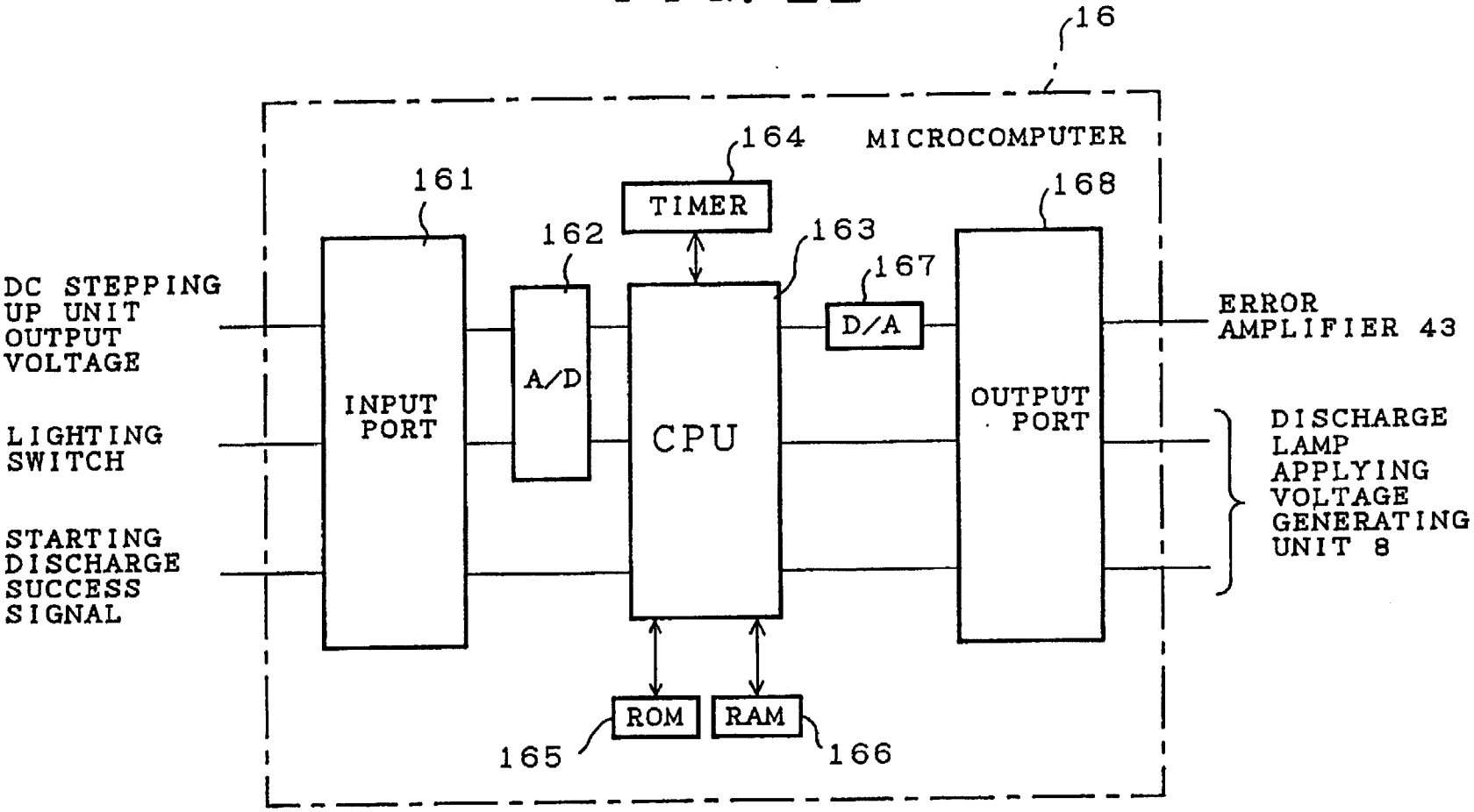
FIG. 22 is a block diagram in which a part of the elements of the embodiment 5 is constituted by a microcomputer.

In FIG. 22 is a block diagram in which the power controlling unit 7, the driver unit 10, the internal temperature inferring unit 13, the period setting unit 14 and the non-lighting time counting unit 22 are realized by using microcomputer 16. The same reference numerals are attached to the same or similar elements as those of FIG. 3 and duplicate explanations are omitted.

Figure 23:
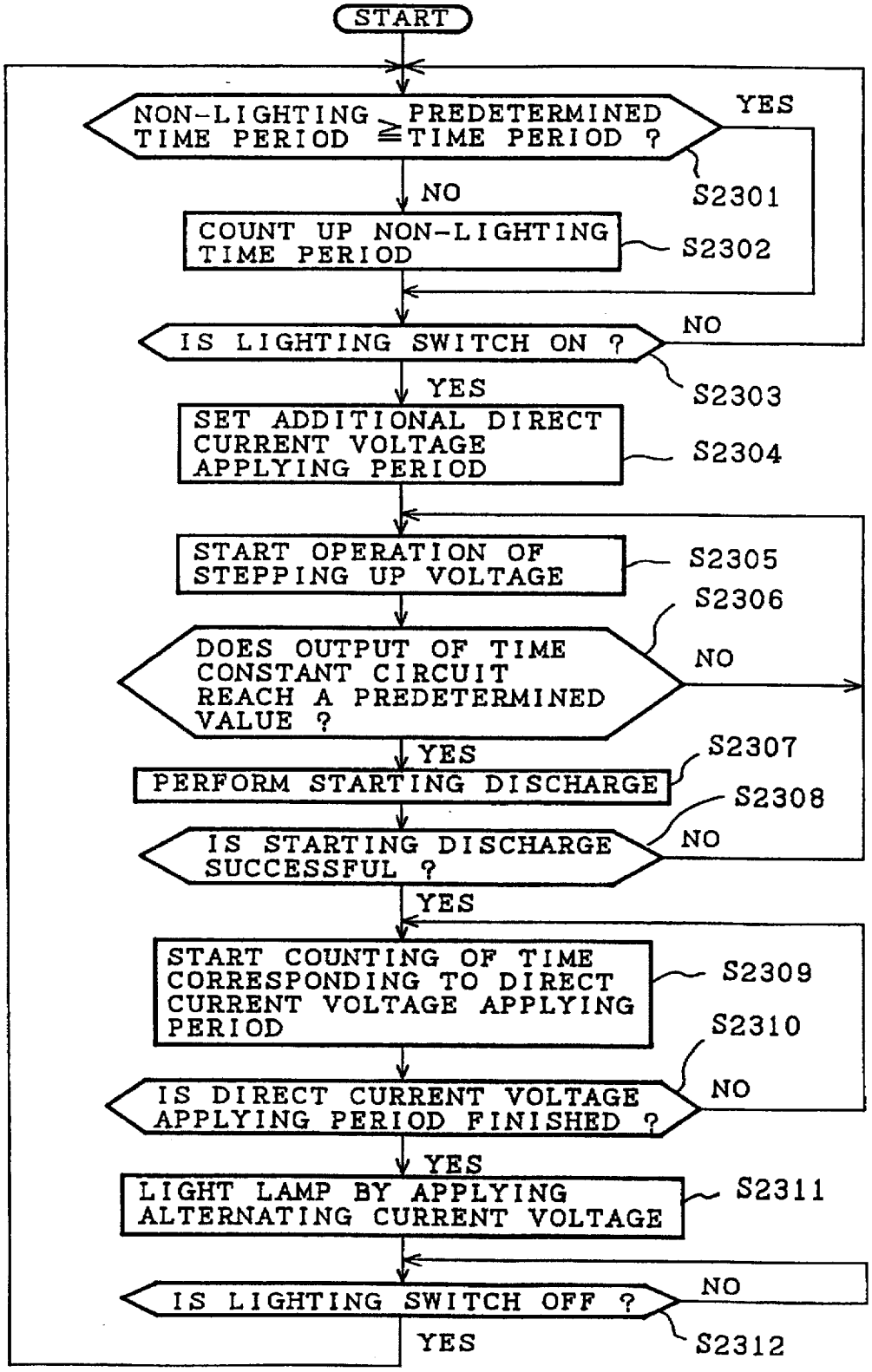
FIG. 23 is a flowchart showing the general operation of the embodiment 5.
Figure 24:
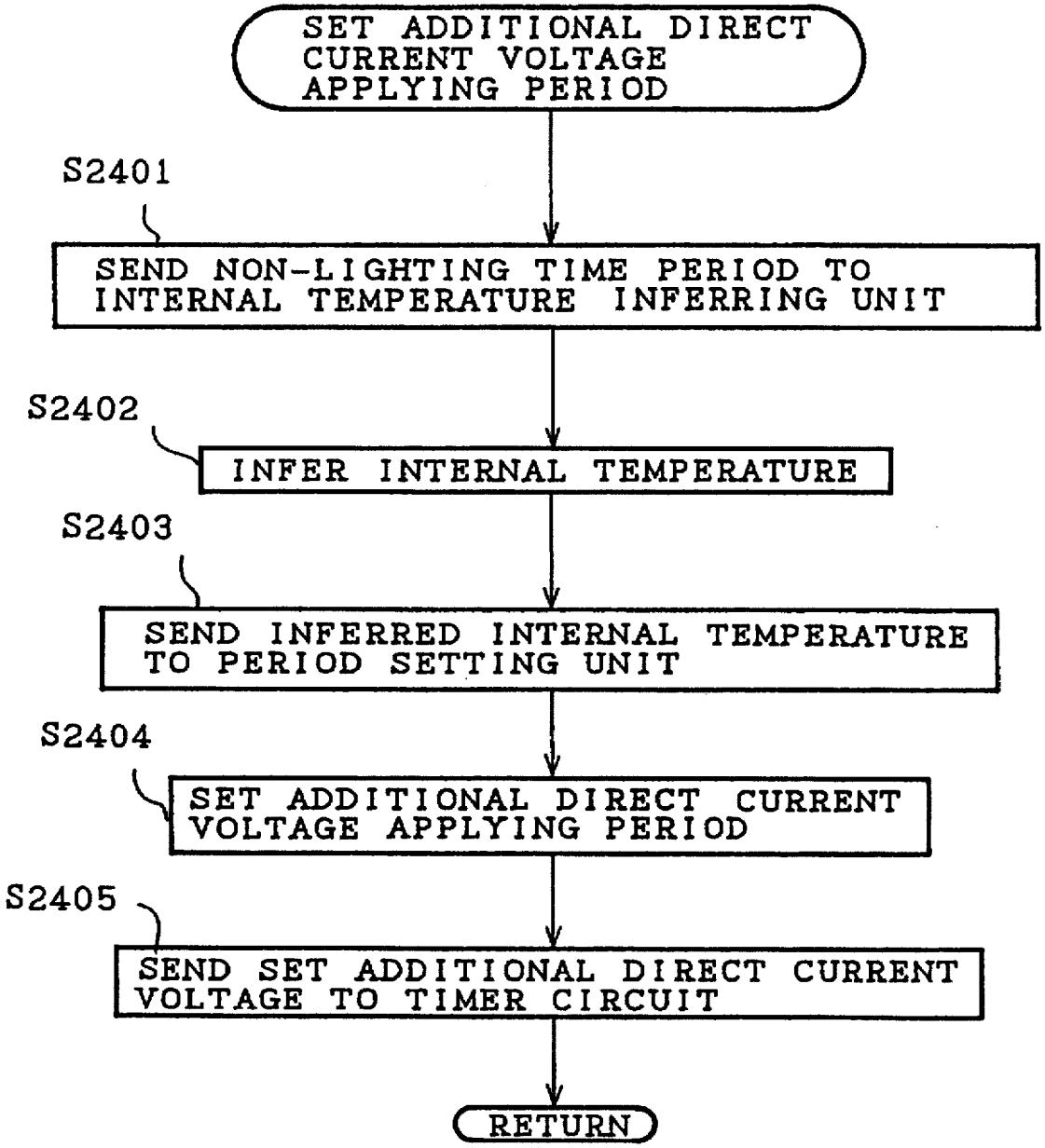
FIG. 24 is a flowchart showing the operation of setting an additional direct current voltage applying period in embodiment 5.

The operations of this embodiment will be explained with reference to FIG. 23. Because all the operations other than the operation of counting up the non-lighting time and the operation of setting an additional direct current voltage applying period are the same as those of embodiment 1, only the operation of counting up non-lighting time and the operation of setting an additional direct current voltage applying period will be explained with reference to the flowcharts of FIGS. 23 and 24 respectively.

As shown in FIG. 8, tube wall temperature of the discharge lamp 12 decreases as time elapses after the lamp is extinguished. Therefore, by measuring non-lighting time period, tube wall temperature $T_{k1}$ of the discharge lamp 12 before discharge can be inferred. Thus, it can be inferred that tube temperature $T_{k1}$ of the discharge lamp 12 before discharge is low and a cold start takes place when the non-lighting time $t_s$ is long, and tube temperature $T_{k1}$ is high and a hot start takes place when the non-lighting time $t_s$ is short. Therefore, the internal temperature of the discharge lamp 12 before discharge can be inferred by measuring the non-lighting time period $t_s$.

If the lighting switch 2 is off, non-lighting counting unit 22 judges if non-lighting time period $t_s$ reaches a predetermined time period $t_x$ at step S2301. The predetermined time period $t_x$ is a time period required for tube wall temperature of the discharge lamp 12 to become equal to the temperature of the atmosphere. In the example of FIG. 8, the time period is approx. 240 seconds. If time period $t_s$ does not reach the predetermined time period $t_x$, non-lighting time period is counted up at step S2302 and if the time period reaches the predetermined time period $t_x$, non-lighting time period is not counted up from that time on.

When the lighting switch 2 is turned on, non-lighting time counting unit 22 sends data indicative of the non-lighting time period $t_s$ to the internal temperature inferring unit 13 at step S2401. A table of non-lighting time—internal temperature is previously stored in the ROM 165 of the microcomputer 16, which shows the relationship between non-lighting time $t_s$ and the corresponding internal temperature of the discharge lamp 12. When the non-lighting time counting unit 22 sends non-lighting time $t_s$, the internal temperature inferring unit 13 infers the corresponding internal temperature of the discharge lamp 12 before discharge, referring to the table of non-lighting time—internal temperature characteristic. Because the operation of setting an additional direct current voltage applying period is the same as that of the embodiment 1, a duplicate explanation is omitted.

As an initial setting, the predetermined time $t_x$ is substituted to a variable of non-lighting time $t_s$. Therefore, the first lighting after the time when the lighting switch 2 is turned on is recognized as being in a condition of a cold start.

Embodiment 6

Next, the sixth embodiment of the invention will be explained with reference to FIG. 25. The same reference numerals are attached to the same or similar elements of those of FIG. 1 and duplicate explanations are omitted.

Figure 25:
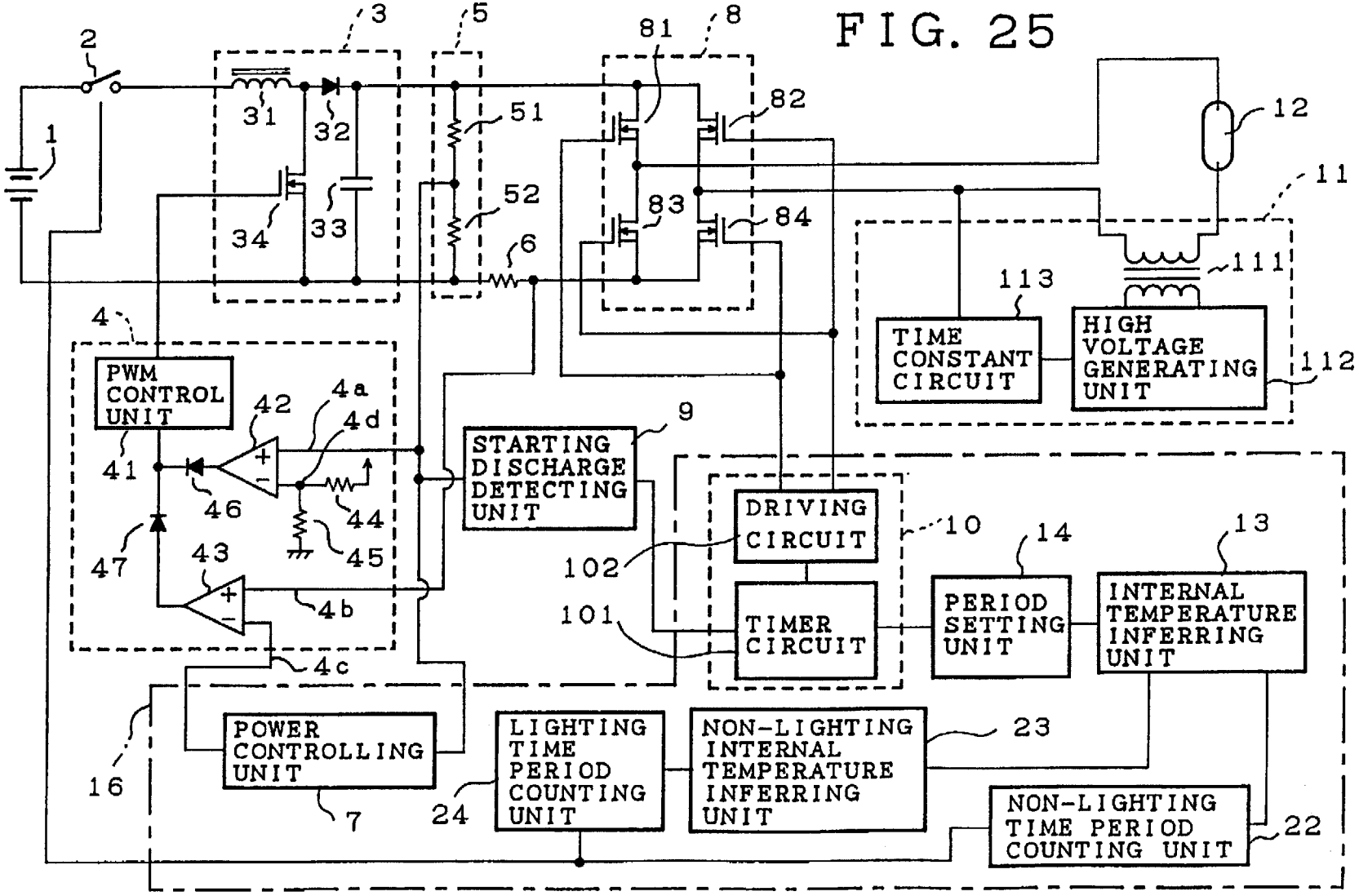
FIG. 25 is a schematic drawing showing the structure of the embodiment 6 of the invention.

In FIG. 25, reference numeral 23 denotes a non-lighting internal temperature inferring unit which infers the internal temperature of the discharge lamp 12 when the lamp 12 is being extinguished, reference numeral 24 denotes a lighting time counting unit which counts a lighting time of the discharge lamp 12 from the time when the lighting switch 2 is turned on to the time when the lighting switch 2 is turned off next.

FIG. 22 is a block diagram in which the power controlling unit 7, the driver unit 10, the internal temperature inferring unit 13, the period setting unit 14, the non-lighting time counting unit 22, non-lighting internal temperature inferring unit 23 and lighting time counting unit 24 are realized by using microcomputer 16. The same reference numerals are attached to the same or similar elements as those of FIG. 3 and duplicate explanations are omitted.

Figure 26:
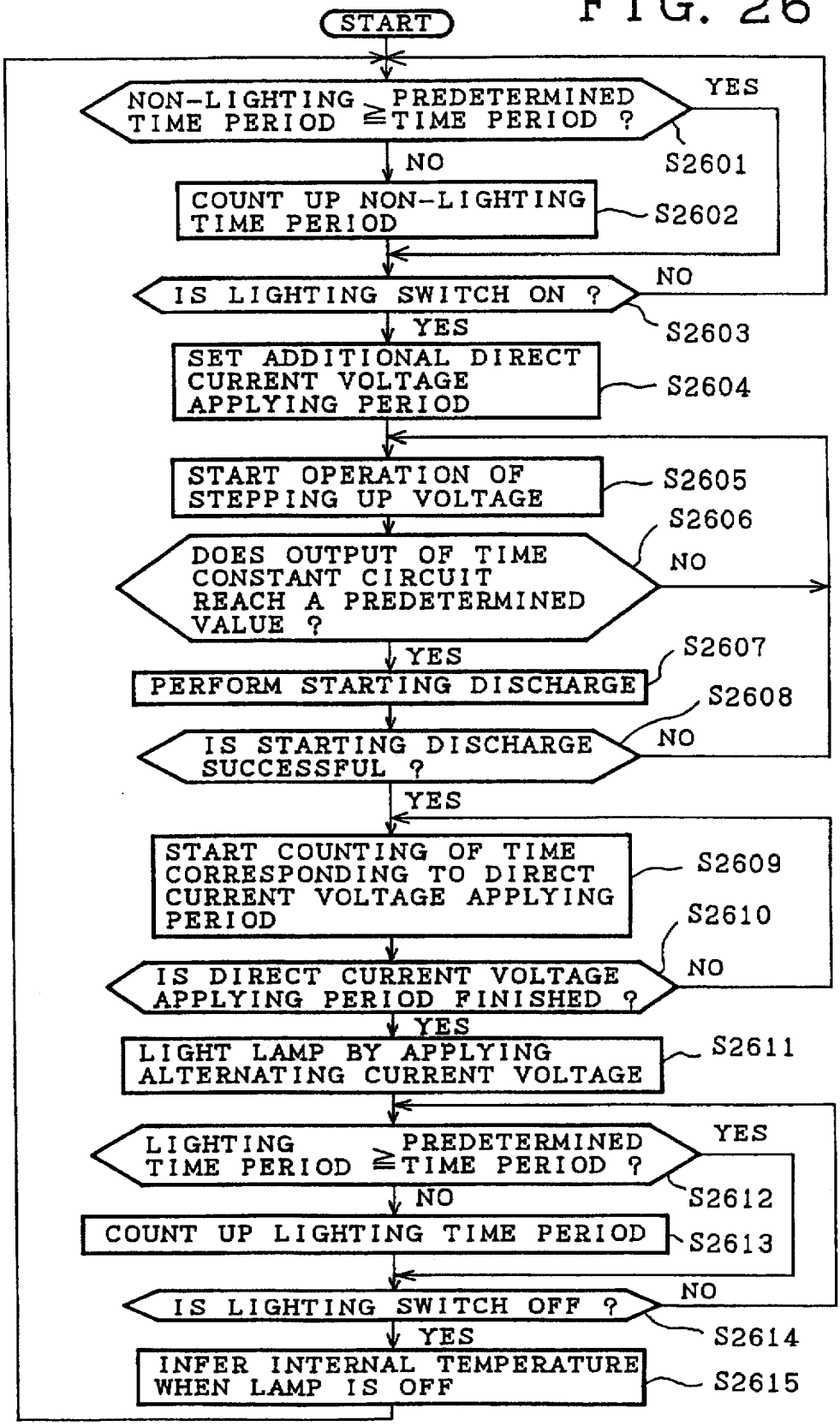
FIG. 26 is a flowchart showing the general operation of the embodiment 6.
Figure 27:
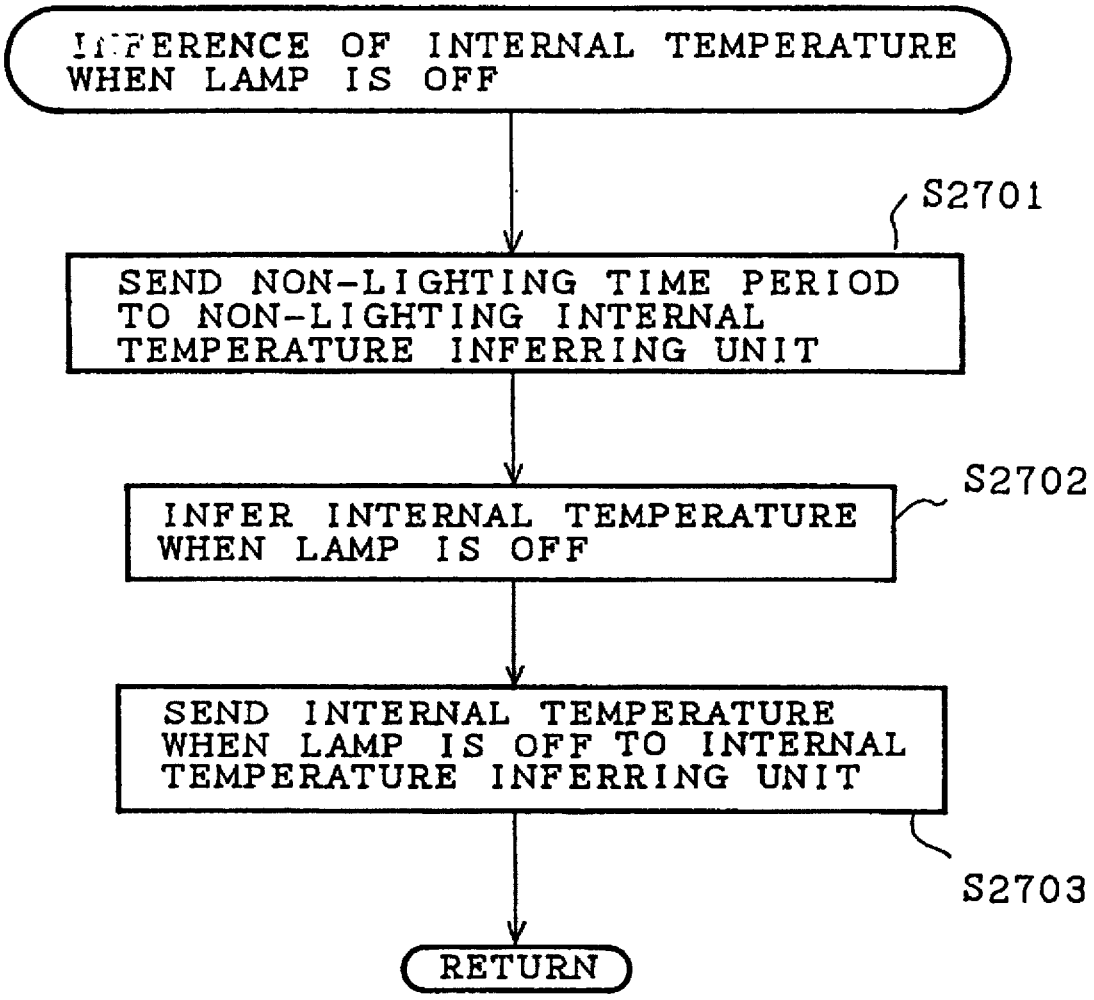
FIG. 27 is a flowchart showing the operation of inferring internal temperature of the discharge lamp at the time when the lamp is extinguished in the embodiment 6.
Figure 28:
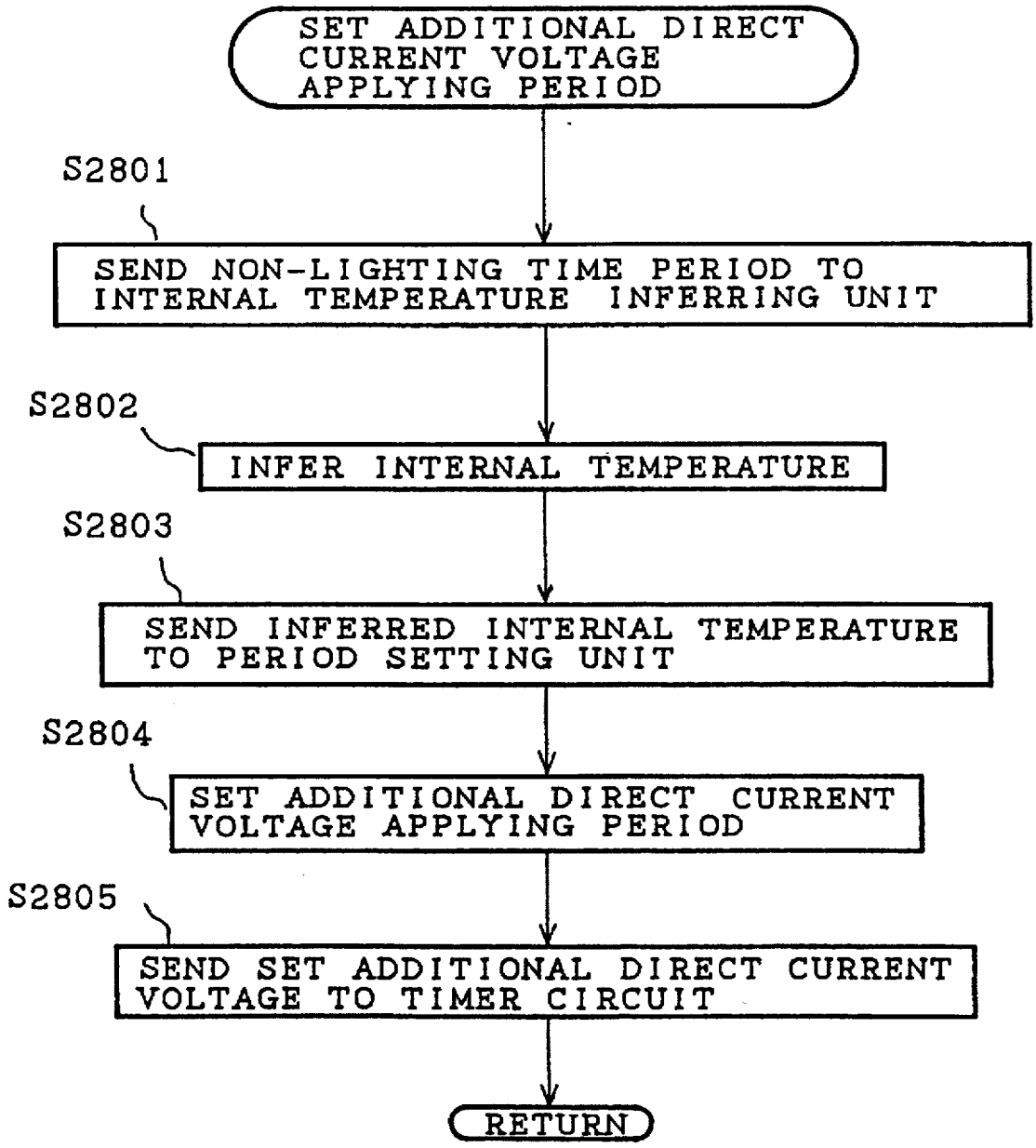
FIG. 28 is a flowchart showing the operation of setting an additional direct current voltage applying period of embodiment 6.

The operations of this embodiment will be explained with reference to the flowchart of FIG. 26. Because all the operations other than the operation of counting up lighting time, the operation of inferring internal temperature at the time when the lamp is extinguished, and the operation of setting an additional direct current voltage applying period are the same as those of the embodiment 5, only these operations will be explained with reference to the flowcharts of FIGS. 26, 27 and 28, respectively and the duplicate explanations are omitted.

Figure 29:
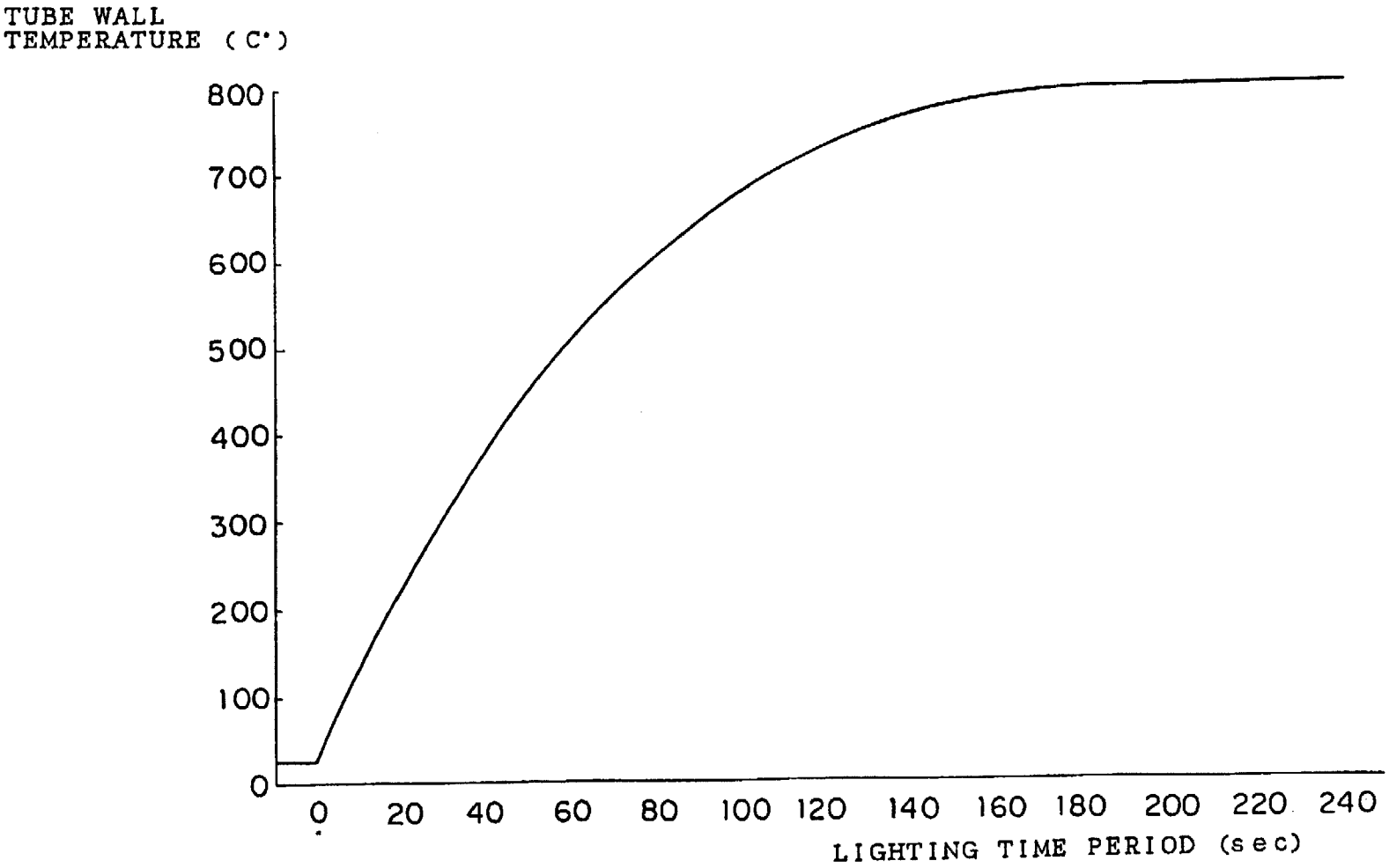
FIG. 29 is a graph showing the relationship between the tube wall temperature after the time when the lamp is lit and elapsing time.

FIG. 29 is a graph showing the relationship between lighting time $t_r$ and the tube wall temperature in the case where the discharge lamp 12 is lit in an atmosphere at 25° C. Tube wall temperature $T_{k2}$ of the discharge lamp 12 at the time when it is extinguished can be inferred by measuring lighting time $t_r$ because the tube wall temperature of the discharge lamp 12 increases as time elapses after the lamp is lit. That is, it can be inferred that tube wall temperature $T_{k2}$ of the discharge lamp 12 at the time when it is extinguished is high when the lighting time period $t_r$ is long and the tube wall temperature $T_{k2}$ is low when the lighting time period $t_r$ is short. Therefore, by measuring the lighting time $t_r$, the internal temperature of the discharge lamp 12 at the time when the lamp 12 is extinguished can be inferred.

When the lighting switch 2 is in on-state, lighting time period counting unit 24 judges if the lighting time $t_r$ reaches a predetermined time period $t_y$ at step S2612. The predetermined time period $t_y$ is a time period required for tube wall temperature of the discharge lamp 12 to become saturated and constant after the lamp is lit. If the time period tt does not reach the predetermined time period $t_y$, the lighting time $t_r$ is counted up at step S2613 and if the time period $t_r$ reaches the predetermined time $t_y$, the lighting time period $t_r$ is not counted up.

If the lighting switch 2 is turned on, the lighting time counting unit 24 sends the lighting time $t_r$ to the non-lighting internal temperature inferring unit 23 at step S2701. A table of lighting time—internal temperature characteristic is previously stored in the ROM 165 of the microcomputer 16, which shows lighting time $t_r$ and corresponding internal temperature of the discharge lamp 12. When the lighting time $t_r$ is sent from the lighting time counting unit 21, the non-lighting internal temperature 23 infers the internal temperature of the discharge lamp 12 at the time when the lamp is extinguished by referring to the table of lighting time—internal temperature characteristic, and by working out how many degrees of the internal temperature is increased from the internal temperature of discharge lamp 12 before discharge, which is sent from the internal temperature inferring unit 13 when the lighting switch 2 is turned on the last time at step S2702. The inferred internal temperature is sent to the internal temperature inferring unit 13 at step S2703.

When the lighting switch 2 is turned on, the non-lighting time counting unit 22 sends data indicative of the non-lighting time period $t_s$ to the internal temperature inferring unit 13 at step S2801. A table of non-lighting time—internal temperature characteristic is previously stored in the ROM 165 of the microcomputer 16, which shows the relationship between non-lighting time $t_s$ and the corresponding internal temperature of the discharge lamp 12. When the non-lighting time counting unit 22 sends non-lighting time $t_2$, the internal temperature of the discharge lamp 12 before discharge is inferred by referring to the table of non-lighting time—internal temperature characteristic, and by working out how many degrees are decreased from the internal temperature of the discharge lamp 12 at the time when it is extinguished, which is sent from the non-lighting internal temperature inferring unit 23 when the lighting switch 2 is turned off at step S2802. The inferred internal temperature of the discharge lamp 12 is sent to the period setting unit 14 and the non-lighting internal temperature inferring unit 23 at step S2403. The operation of setting an additional direct current voltage applying period based on the internal temperature of the discharge lamp 12 is the same as that of the embodiment 1 and duplicate explanation is omitted.

Embodiment 7

The seventh embodiment of the invention will be explained with reference to FIG. 30. The same reference numerals are attached to the same or similar elements as those of FIG. 1 and duplicate explanations are omitted.

Figure 30:
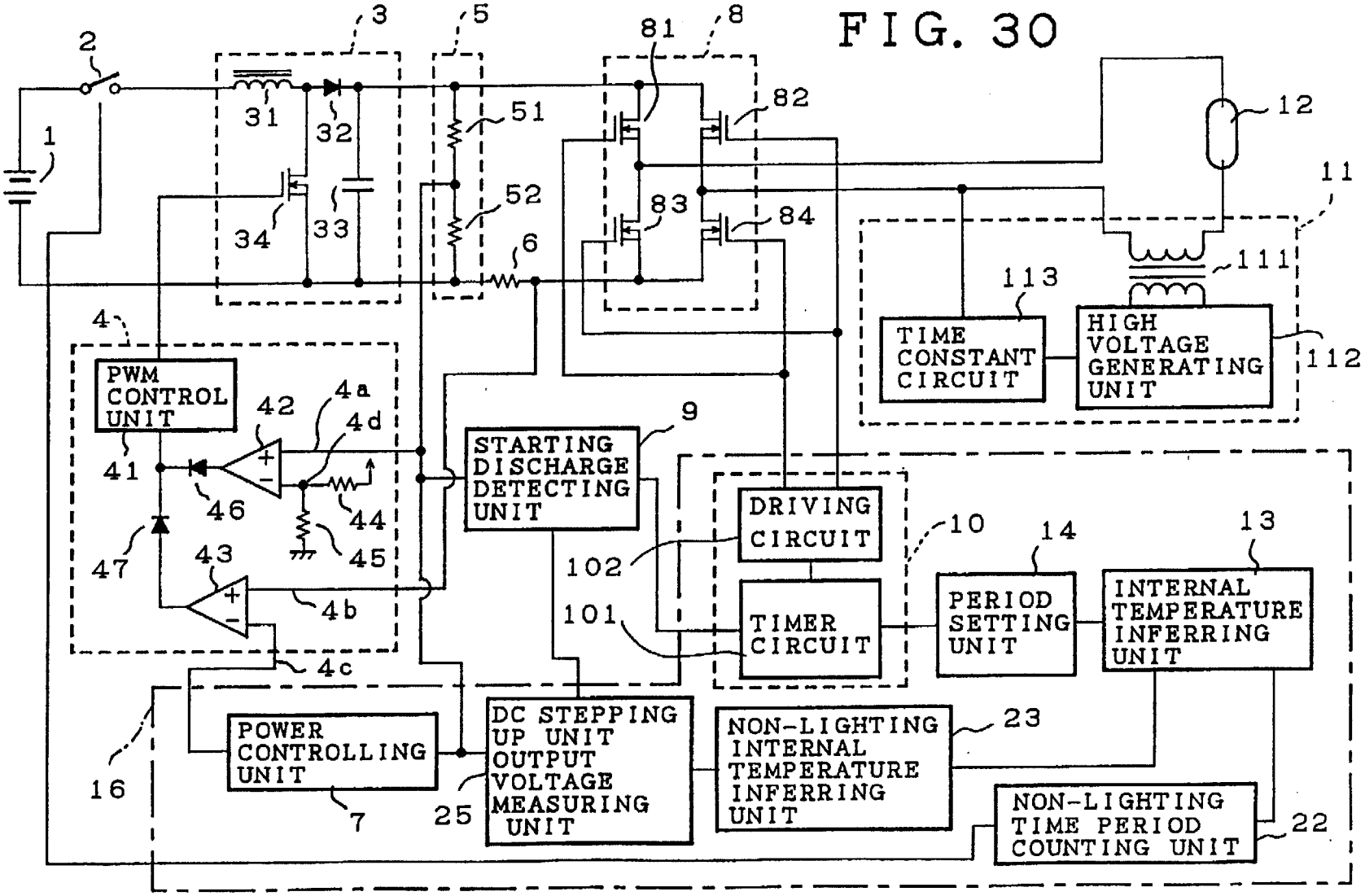
FIG. 30 is a schematic drawing showing the structure of the embodiment 7 of the invention.

In FIG. 30, reference numeral 25 denotes a DC stepping up unit output voltage measuring unit which stores the minimum voltage outputted from the DC stepping up unit 3 in a cold start and the voltage outputted from the DC stepping up unit 3 when the lamp is lit at rated power, and which measures the voltage outputted from the DC stepping up unit 3 when the discharge lamp 12 is extinguished.

FIG. 22 is a block diagram in which the power cotrolling unit 7, the driver unit 10, the internal temperature inferring unit 13, the period setting unit 14, the non-lighting time counting unit 22, non-lighting internal temperature inferring unit 23 and DC stepping up unit output voltage measuring unit 25 are realized by using microcomputer 16. The same reference numerals are attached to the same or similar elements as those of FIG. 3 and duplicate explanations are omitted.

Figure 31:
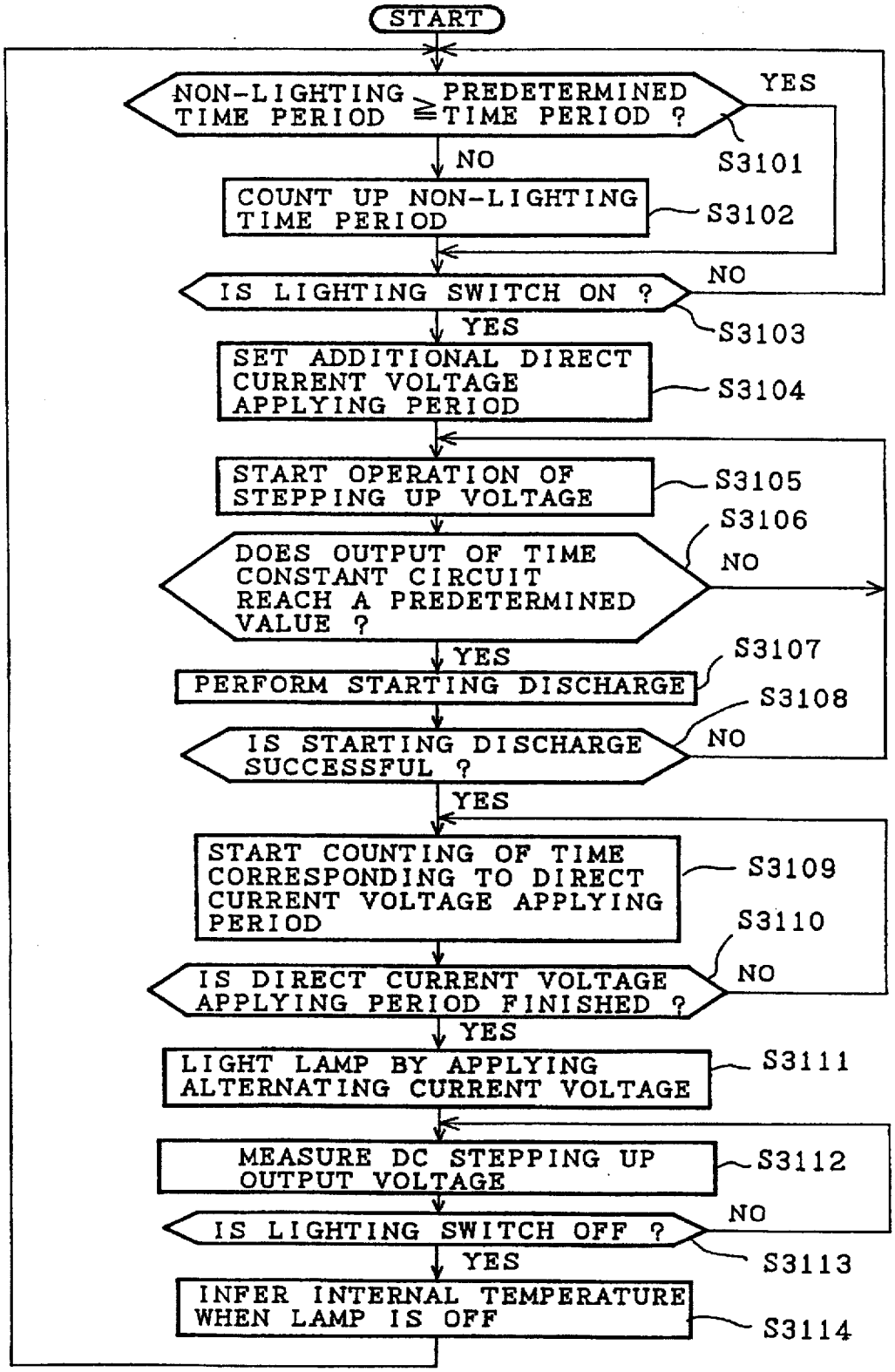
FIG. 31 is a flowchart showing the general operation of the embodiment 7.
Figure 32:
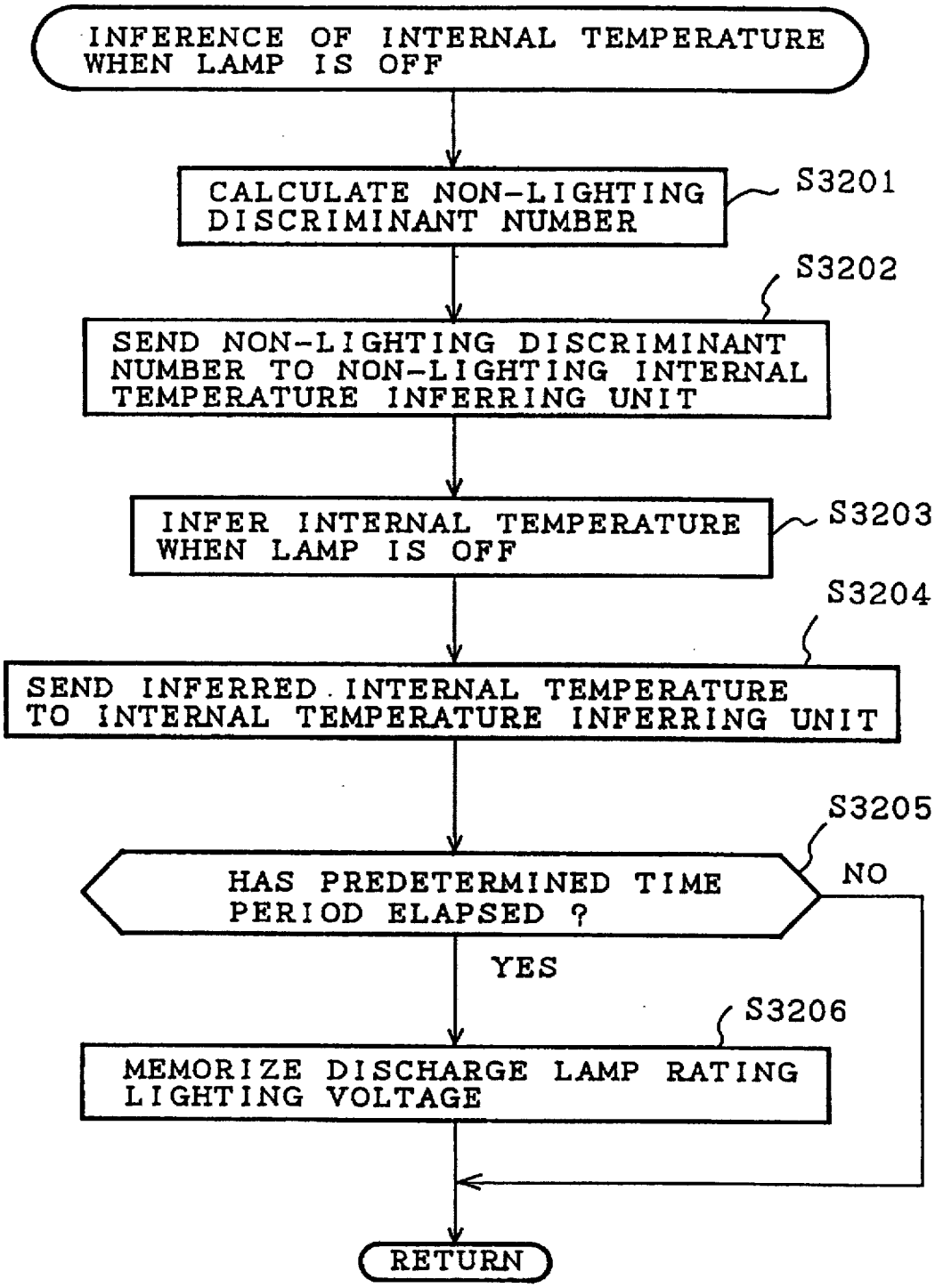
FIG. 32 is a flowchart showing the operation of inferring internal temperature of the discharge lamp at the time when the lamp is extinguished in the embodiment 7.

The operations of this embodiment will be explained with reference to the flowchart of FIG. 31. Because the all of the operations other than the operation of measuring voltage outputted from the DC stepping up unit and the operation of inferring non-lighting internal temperature are the same as those of the embodiment 6, only these operations will be explained with reference to FIGS. 31 and 32 respectively and the explanation of the other operations are omitted.

A temperature of the discharge lamp 12 increases after the lamp is lit as time elapses. On the other hand, the voltage outputted from the DC stepping unit 3 drops once after dielectric breakdown takes place and thereafter it increases as time elapses. Meanwhile voltage $V_L$ outputted from the DC stepping up unit 3 is stabilized to the voltage in lighting at rated power and tube wall temperature is saturated. An increase amount of tube wall temperature $T_{k2}$ can be inferred by measuring an increase amount of the voltage $V_{LE}$ after dielectric breakdown takes place, which is outputted from the DC stepping up unit 3 when the lamp 12 is extinguished.

However, tube wall temperature depends on the voltage outputted from the DC stepping up unit 3 when the lamp is lit at rated power. For example, assuming that the voltage outputted from the DC stepping up unit 3 is 80 volts, tube wall temperature $T_{k2}$ at the time when it is extinguished is saturated if the voltage outputted from the DC stepping up unit 3 in lighting at rated power is also 80 volts, and tube wall temperature $T_{k2}$ is increasing if the voltage outputted from the DC stepping up unit 3 in lighting at rated power is 100 volts. Therefore, tube wall temperature $T_{k2}$ at the time when the lamp 12 is extinguished can be inferred from the voltage $V_{LE}$ by measuring the voltage outputted from the DC stepping up unit 3 in lighting at rated power in advance.

Let minimum voltage outputted from the DC stepping up unit 3 in a cold start be $V_{LL}$, voltage outputted from the DC stepping up unit 3 in lighting at rated power be $V_{LH}$, the voltage outputted from the DC stepping up unit 3 at the time when the lamp 12 is extinguished be $V_{LE}$. Then, non-lighting discriminant number is defined by the following equation:

$$\beta=(V_{LE}-V_{LL})/(V_{LH}-V_{LL}).$$

IF the voltage $V_{LE}$ is nearly equal to the voltage $V_{LL}$, number $\beta\approx 0$ and tube wall temperature $T_{k2}$ at the time when the lamp is extinguished is hardly increasing. On the other hand, if the voltage $V_{LE}$ is nearly equal to the voltage $V_{LH}$, $\beta\approx 1$ and tube wall temperature $T_{k2}$ has been increased almost to the saturated temperature. Therefore, the closer the number $\beta$ comes to 0, the lower the internal temperature of the discharge lamp 12 is, and the closer the number $\beta$ comes to 1, the higher the internal temperature of the discharge lamp 12 is. Therefore, internal temperature of the discharge lamp 12 at the time when the lamp 12 is extinguished can be inferred by storing minimum voltage $V_{LL}$ from the unit 3 in a cold start and voltage $V_{LH}$ in lighting at rated power, and by measuring voltage outputted from the DC stepping up unit 3 at each time when the lamp is extinguished.

When the lighting switch 2 is turned on, the DC stepping unit output voltage measuring unit 25 measures a voltage outputted from the DC stepping up unit 3 at step S3112. When the lighting switch 2 is turned off, the DC stepping up unit output voltage which is measured the last time is substituted to the variable of the voltage $V_{LE}$.

When the lighting switch 2 is turned off, voltage measuring unit 25 calculates non-lighting discriminant number $\beta$ using the above equation at step S3201, the discriminant number $\beta$ is sent to the non-lighting internal temperature inferring unit 23 at step S3202. A table of non-lighting discriminant number—internal temperature characteristic, which shows the relationship between non-lighting discriminant number $\beta$ and corresponding internal temperature of the discharge lamp 12 is previously stored in the ROM 165 of the microcomputer 16. When the non-lighting discriminant number $\beta$ is sent from the voltage measuring unit 25, the non-lighting internal temperature inferring unit 23 infers the corresponding internal temperature of the discharge lamp 12 at the time when the lamp is extinguished at step S3203. The inferred internal temperature is sent to the internal temperature inferring unit 13 at step S3204. The operation of inferring temperature of the discharge lamp 12 before discharge is the same as that of the embodiment 6 and duplicate explanation is omitted.

The voltage measuring unit 25 judges whether the voltage $V_L$ outputted from the DC stepping up unit 3 reaches the voltage in lighting at rated power at step S3205. If so, the voltage $V_L$ is memorized as the voltage $V_{LH}$ outputted from the unit 3 in lighting at rated power.

Embodiment 8

Next, the eighth embodiment of the invention will be explained with reference to FIG. 33. The same reference numerals are attached to the same or similar elements of those of FIG. 1 and duplicate explanations are omitted.

Figure 33:
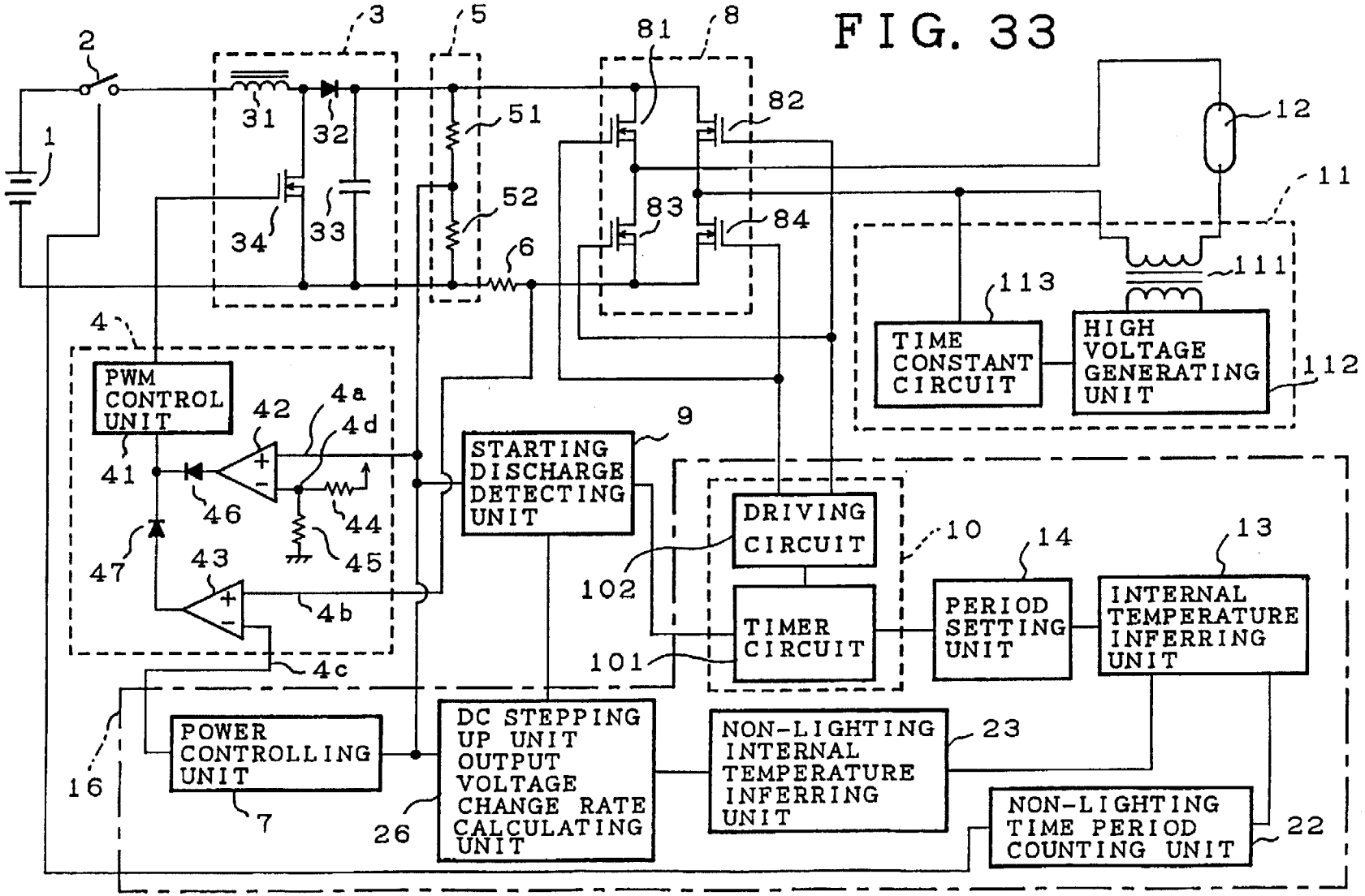
FIG. 33 is a schematic drawing showing the structure of the embodiment 8 of the invention.

In FIG. 33, reference numeral 26 denotes a DC stepping unit output voltage change rate calculating unit which calculates a change rate of the voltage outputted from the DC stepping up unit 3 by sampling voltage at an appropriate interval from the time when the voltage from the unit 3 becomes minimum after the lighting switch 2 is turned on to the time when the lighting switch 2 is turned off.

FIG. 22 is a block diagram in which the power controlling unit 7, the driver unit 10, the internal temperature inferring unit 13, the period setting unit 14, the non-lighting time counting unit 22, non-lighting internal temperature inferring unit 23 and DC stepping up unit output voltage changing rate calculating unit 25 are realized by using microcomputer 16. The same reference numerals are attached to the same or similar elements as those of FIG. 3

Figure 34:
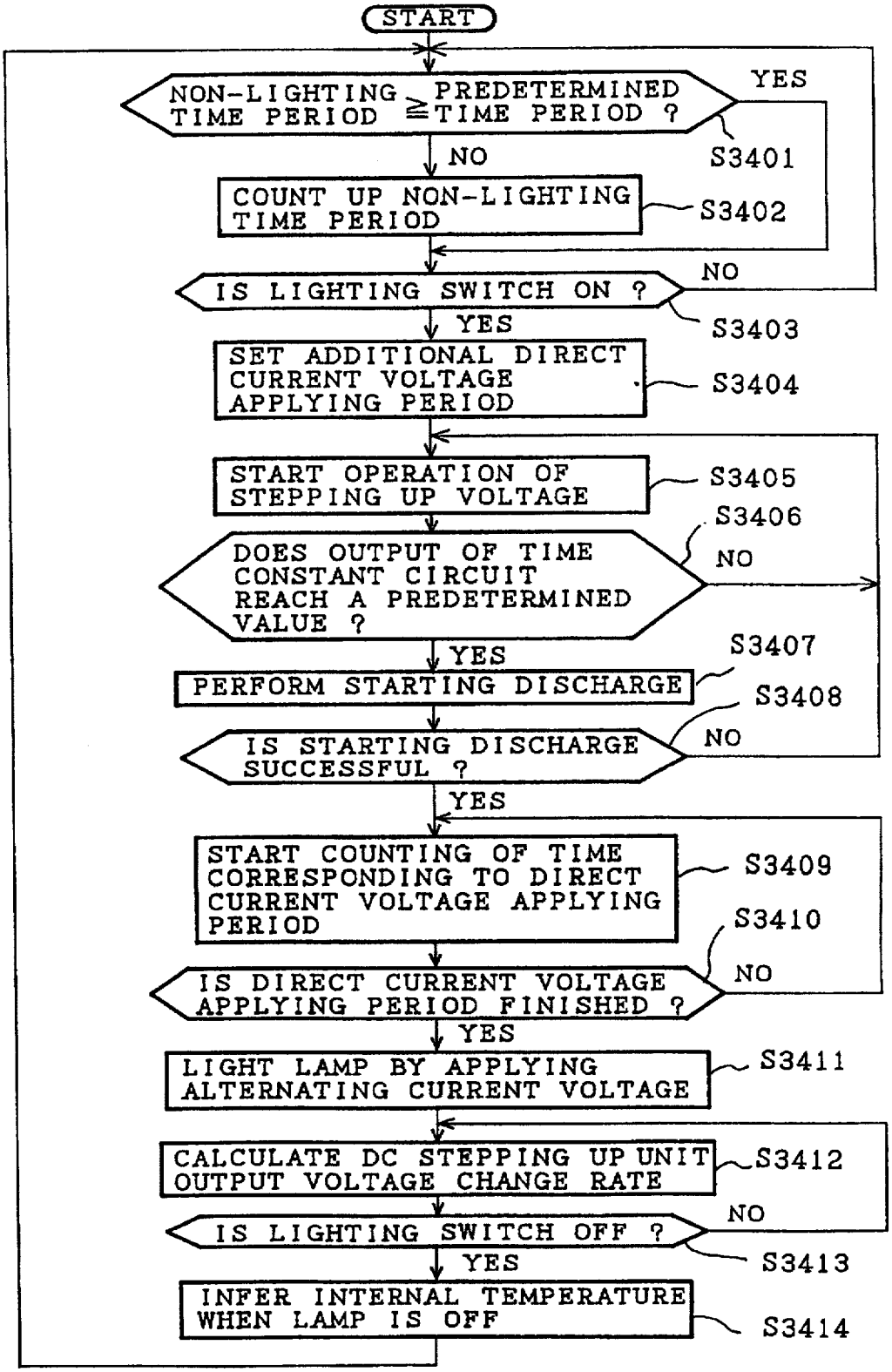
FIG. 34 is a flowchart showing the general operation of the embodiment 8.
Figure 35:
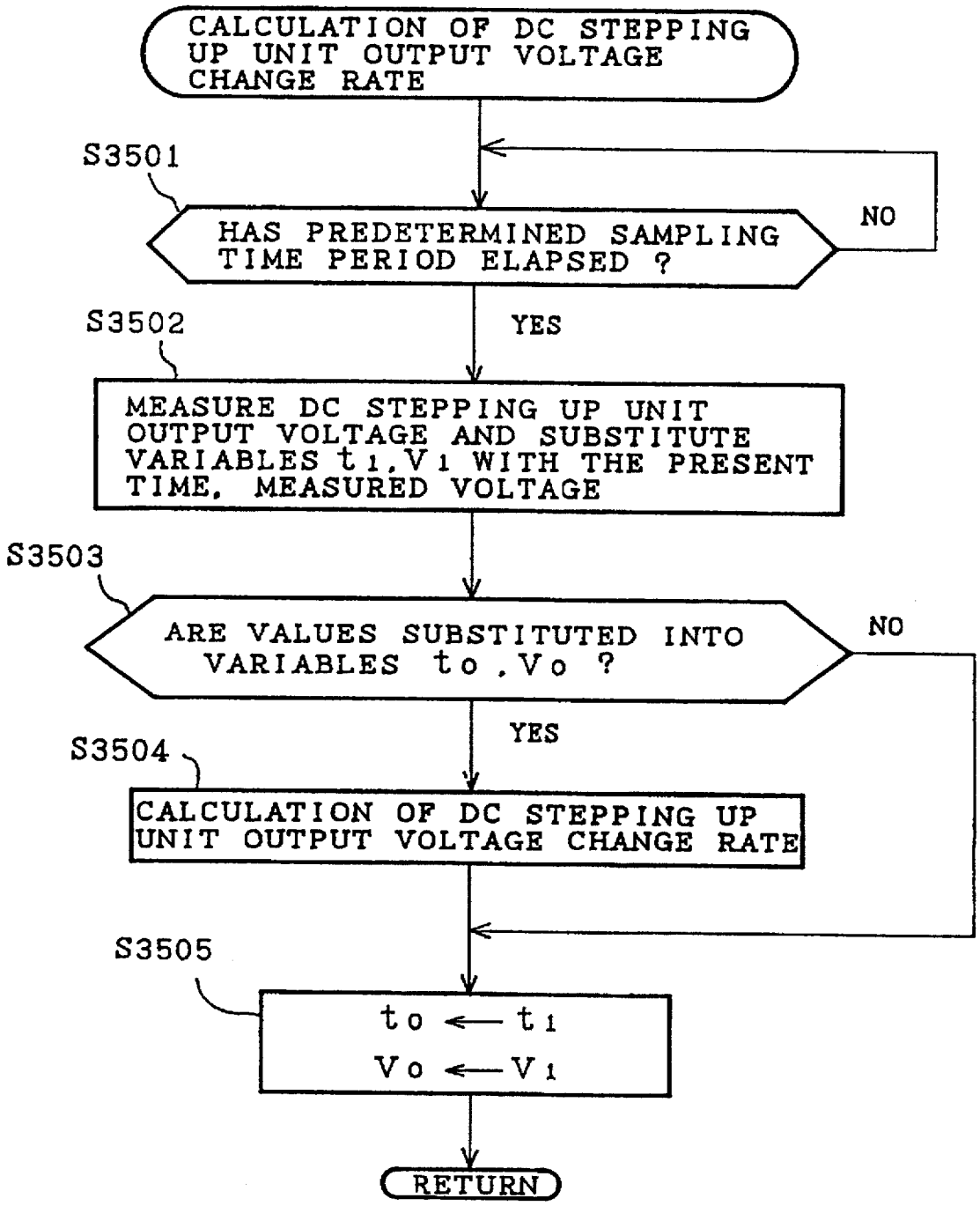
FIG. 35 is a flowchart showing the operation of calculating a change rate of voltage outputted from the DC stepping up unit in the embodiment 8.
Figure 36:
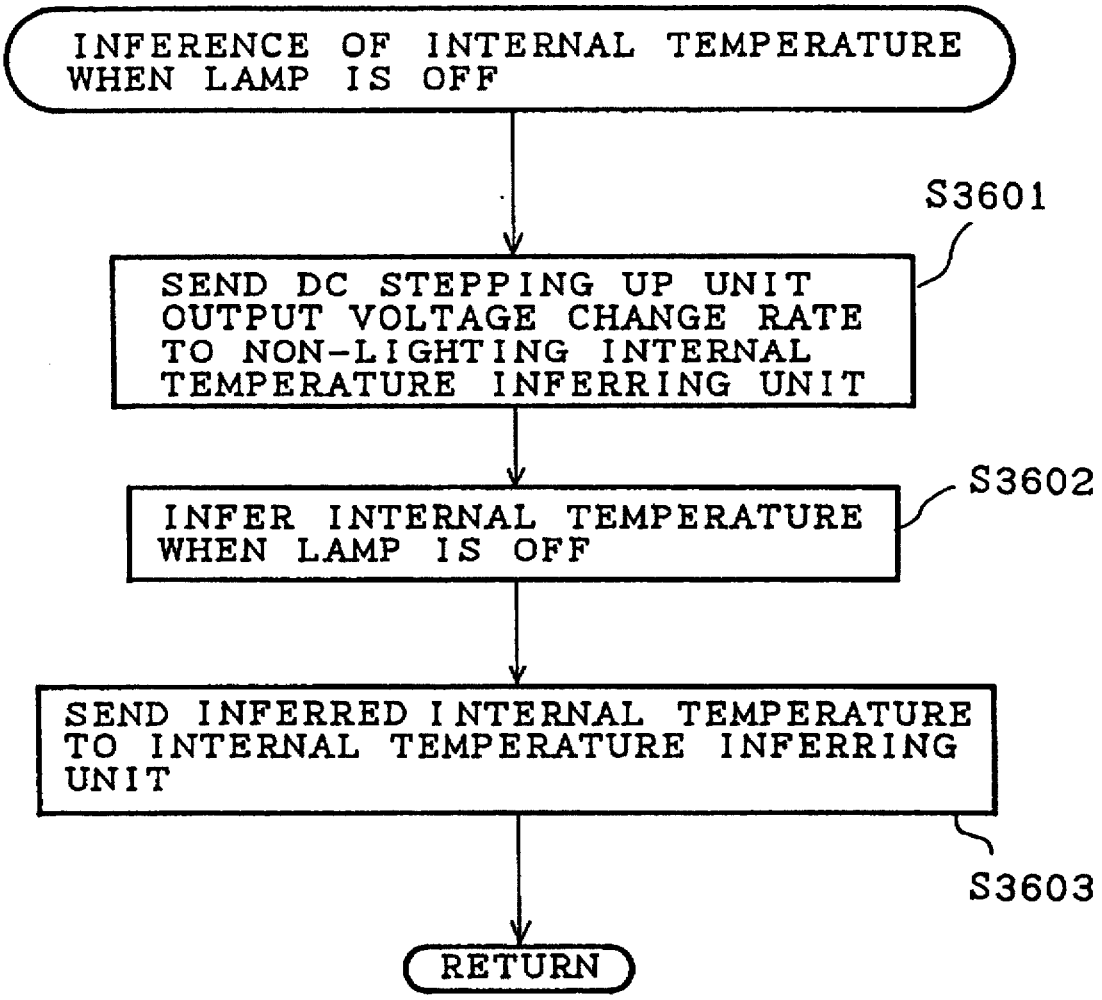
FIG. 36 is a flowchart showing the operation of inferring internal temperature of the discharge lamp at the time when the lamp is extinguished in the embodiment 8.
Figure 37:
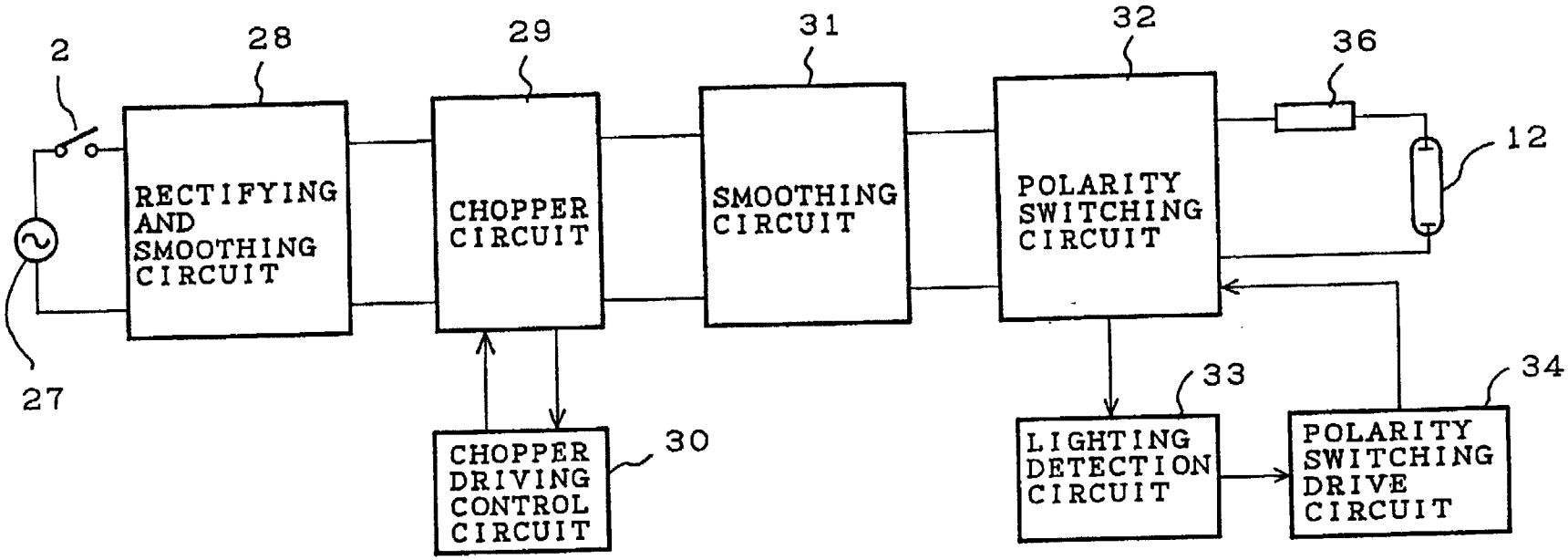
FIG. 37 (PRIOR ART)
FIG. 37 is a block diagram showing the structure of a conventional alternating current discharge lamp lighting apparatus.
Figure 38:
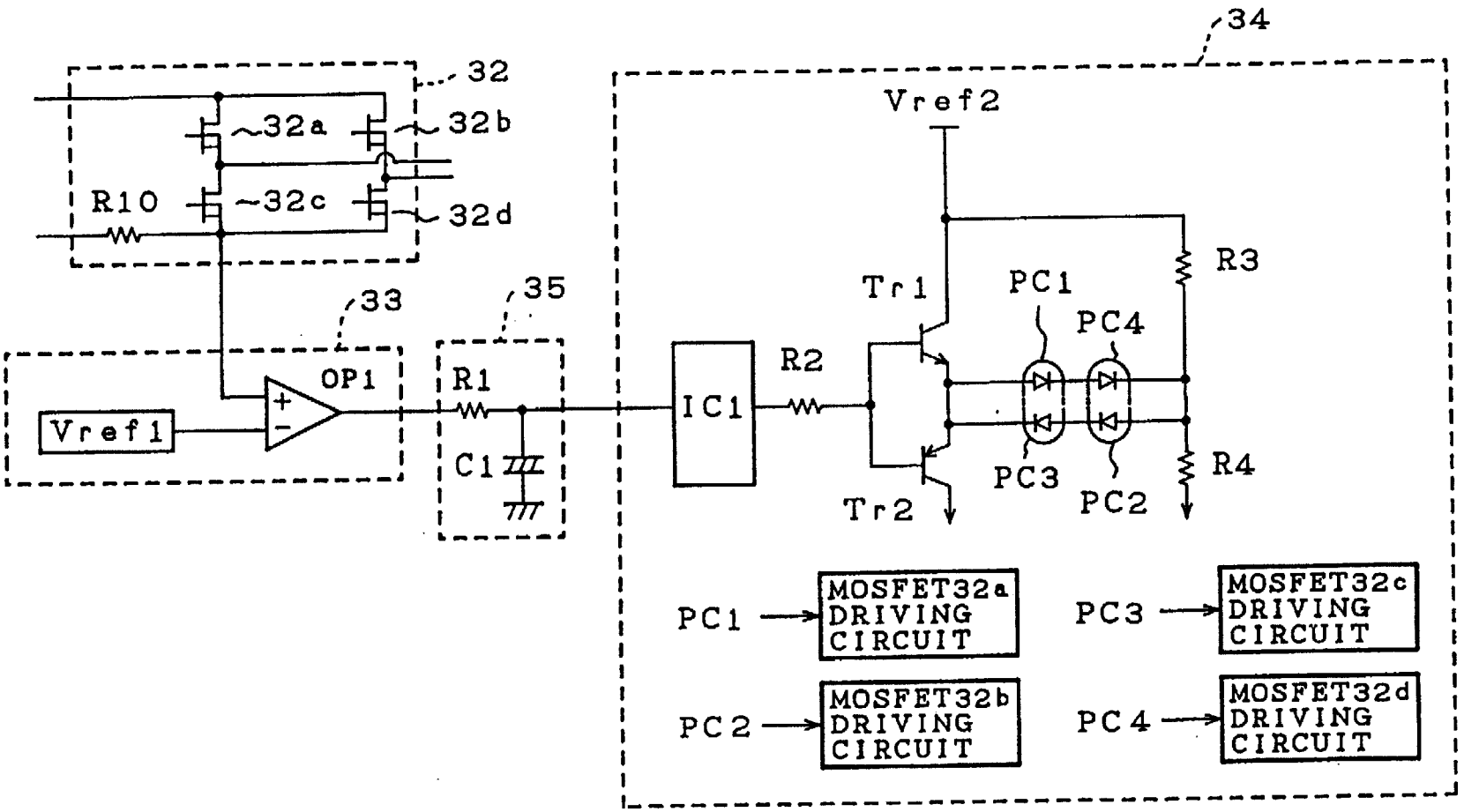
FIG. 38 (PRIOR ART)
FIG. 38 is a circuit diagram showing the detailed structure of the conventional alternating current discharge lamp lighting apparatus.

The operation of this embodiment will be explained with reference to the flowchart of FIG. 34. Because all the operations other than the operation of calculating voltage change rate and the operation of inferring the internal temperature at the time when the lamp 12 is extinguished are the same as those of the embodiment 6, only these operations will be explained with reference to the FIGS. 35 and 36 respectively and the explanations of the other operations are omitted. The voltage outputted from the DC stepping up unit 3 drops once after dielectric breakdown and increases as time elapses to the voltage in lighting at rated power. A voltage change rate of the output voltage from DC stepping unit 3 is high when the voltage is low and the rate become lower as the voltage comes closer to the voltage in lighting at rated power. Namely, It is inferred that when the voltage change rate is high, tube wall temperature $T_{k2}$ at the time when the lamp 12 is extinguished is low and internal temperature is also low, and when the voltage change rate is low, tube wall temperature $T_{k2}$ at the time when the lamp 12 is extinguished is high and internal temperature is also high.

When the lighting switch 2 is turned on, the starting discharge takes place in the discharge lamp 12 and the voltage from the DC stepping up unit 3 becomes minimum, the voltage change rate calculating unit 26 judges whether a sampling time period $\tau$ elapses at step S3501. If so, the voltage change rate calculating unit 26 measures a voltage outputted from the DC stepping up unit 3 and sets the measured voltage as a voltage $V_1$ of $t_1$ at step S3502. Next, the unit 26 checks if values are substituted to variables time $t_0$, voltage $V_0$ at step S3503. If so, a voltage change rate is calculated at step S3504 using the following equation:

$$\eta=(V_1-V_0)/\tau.$$

The voltage change rate calculating unit 26 replace the voltage $V_1$ of time $t_1$ with the voltage $V_0$ of time $t_0$ at step S3505 and thereafter the unit 26 keeps calculating voltage change rate until the lighting switch 2 is turned off.

When the lighting switch 2 is turned off, voltage change rate calculating unit 26 sets the voltage change rate $\eta$ which has been calculated the last time before the lighting switch 2 is turned off as a voltage change rate $\eta_E$ at the time when the lamp is turned off and the voltage change rate $\eta_E$ is sent to the non-lighting internal temperature inferring unit 23 at step S3601. A table of voltage change rate at the time when the lamp is extinguished—internal temperature characteristic is previously stored in the ROM 165 of the microcomputer 16, which shows the relationship between the voltage change rate $\eta_E$ and corresponding internal temperature of the discharge lamp 12. When the voltage change rate $\eta_E$ is sent from the voltage change rate calculation unit 26, the non-lighting internal temperature inferring unit 23 infers corresponding internal temperature of discharge lamp 12 at the time when the lamp is turned off, referring to the table, at step S3602. The inferred internal temperature of the discharge lamp 12 at the time when the lamp is turned off is sent to the internal temperature inferring unit 13 at step S3603. The operation for inferring the internal temperature is the same as those of the embodiment 6 and duplicate explanation is omitted.

The above embodiments can be combined each other to infer internal temperature of the discharge lamp before discharge in higher accuracy. For example, tube wall temperature calculating unit 152 of FIG. 1 can be combined with the DC stepping up unit output minimum voltage measuring unit 19.

What is claimed is:

1. An apparatus for lighting a discharge lamp, comprising:

direct current power generating means for generating direct current power;

first internal state inferring means for inferring a first internal state of said discharge lamp;

adjusting means for adjusting a direct current voltage applying period during which said direct current voltage is applied to said discharge lamp based on said inferred first internal state, said adjusting means adjusting said direct current voltage applying period before applying said direct current voltage to said discharge lamp for the first time after receiving an instruction to start lighting said discharge lamp; and applying means for applying said direct current voltage and an alternating current voltage to said discharge lamp by switching said direct current power, said applying means applying said direct current voltage to said discharge lamp for said adjusted direct current voltage applying period upon receiving said instruction to start lighting said discharge lamp and for applying said alternating current voltage to said discharge lamp after said direct current voltage applying period elapses.

2. An apparatus according to claim 1, further comprising:

measuring means for measuring a tube wall temperature of said discharge lamp, and wherein said first internal state inferring means infers said first internal state of said discharge lamp before discharge based on said measured tube wall temperature.

3. An apparatus according to claim 1, further comprising:

an enclosure which encloses said discharge lamp; and measuring means for measuring a temperature inside said enclosure, and wherein said first internal state inferring means infers said first internal state of said discharge lamp before discharge based on said measured temperature inside said enclosure.

4. An apparatus according to claim 1, further comprising:

means for memorizing a first voltage which is a minimum voltage outputted from said direct current power generating means after discharge in a cold start of said discharge lamp;

means for memorizing a second voltage which is a voltage outputted from said direct current power generating means when said discharge lamp is on at a rated power;

means for measuring a third voltage which is a minimum voltage outputted from said direct current power generating means after discharge each time when said discharge lamp is lit; and means for calculating a lighting state discriminant number which is a ratio of a difference between said third voltage and said first voltage to a difference between said second voltage and said first voltage, and wherein said first internal state inferring means infers said first internal state of said discharge lamp before discharge based on the calculated lighting state discriminant number.

5. An apparatus according to claim 1, further comprising:

means for calculating a voltage change rate of voltage outputted from said direct current power generating means based on voltages outputted from said direct current power generating means at least two predetermined points of time after a time when a voltage outputted from said direct current power generating means becomes minimum after discharge takes place, and wherein said first internal state inferring means infers said first internal state of said discharge lamp before discharge based on the calculated voltage change rate.

6. An apparatus according to claim 1, further comprising:

means for measuring a non-lighting time period during which said discharge lamp is off, and wherein said first internal state inferring means infers said first internal state of said discharge lamp before discharge based on the measured non-lighting time period.

7. An apparatus according to claim 6, wherein said non-lighting time period measuring means stops measuring said non-lighting time period after a predetermined time period elapses from a time when said discharge lamp is turned off.

8. An apparatus according to claim 6, further comprising:

second internal state inferring means for inferring a second internal state of said discharge lamp at a time when said discharge lamp is turned off, and wherein said first internal state inferring means infers said first internal state of said discharge lamp before discharge based on the measured non-lighting time period and said inferred second internal state of said discharge lamp.

9. An apparatus according to claim 8, further comprising:

means for measuring a lighting time period during which said discharge lamp is on, and wherein said second internal state inferring means infers said second internal state of said discharge lamp at a time when said discharge lamp is turned off based on said measured lighting time period.

10. An apparatus according to claim 8, further comprising:

means for memorizing a first voltage which is a minimum voltage outputted from said direct current power generating means after discharge in a cold start of said discharge lamp;

means for memorizing a second voltage which is a voltage outputted from said direct current power generating means when said discharge lamp is being lit at a rated power;

means for measuring a third voltage which is a voltage outputted from said direct current power generating means each time when said discharge lamp is turned off; and means for calculating a non-lighting state discriminant number which is a ratio of a difference between said third voltage and said first voltage to a difference between said second voltage and said first voltage, and wherein said second internal state inferring means infers said second internal state of said discharge lamp at a time when said discharge lamp is turned off based on said calculated non-lighting state discriminant number.

11. An apparatus according to claim 8, further comprising:

means for calculating a voltage change rate of voltage outputted from said direct current power generating means based on voltages sampled at arbitrary points in time from a time when a output voltage becomes minimum after discharge from a time when said discharge lamp is turned off, and wherein said second internal state inferring means infers said second internal state of said discharge lamp at the time when said discharge lamp is turned off based on the calculated voltage change rate before turning off of said discharge lamp.

12. An apparatus for lighting a discharge lamp comprising:

a voltage applying unit which applies a direct current voltage to said discharge lamp;

a first internal condition inferring unit which infers a first internal condition of said discharge lamp;

an adjusting unit which adjusts a direct current voltage applying time period to apply said direct current voltage to said discharge lamp based on said first internal condition, said adjusting unit adjusting said direct current voltage applying period before applying said direct current voltage to said discharge lamp for the first time after receiving an instruction to start lighting said discharge lamp; and a controlling unit which controls said voltage applying unit to apply said direct current voltage to said discharge lamp for said adjusted direct current voltage applying time period after receiving said instruction to turn on said discharge lamp.

13. An apparatus of claim 12, wherein said first internal condition inferring unit includes, a detecting unit which detects a tube wall temperature of said discharge lamp, and wherein said first internal condition inferring unit infers said first internal condition of said discharge lamp based on said detected tube wall temperature.

14. An apparatus of claim 12, further comprising:

an enclosure which encloses said discharge lamp, wherein said first internal condition inferring unit includes, a detecting unit which detects a temperature inside said enclosure, and wherein said first internal condition inferring unit infers said first internal condition of said discharge lamp based on said detected temperature inside said enclosure.

15. An apparatus of claim 12, wherein said first internal condition inferring unit includes, a first memory which memorizes a first voltage which is a minimum voltage applied to said discharge lamp after discharge in a cold start of said discharge lamp, a second memory which memorizes a second voltage applied to said discharge lamp when said discharge lamp is being lighted at a rated power, a third memory which memorizes a third voltage which is a minimum voltage applied to said discharge lamp after each time said discharge lamp is lit, and a calculator which calculates a lighting state discriminant number which is a ratio of a difference between said third voltage and said first voltage and a difference between said second voltage and said first voltage, and wherein said first internal condition inferring unit infers said first internal condition of said discharge lamp before discharge based on said calculated discriminant number.

16. An apparatus of claim 12, further comprising:

a calculator which calculates a changing rate of voltage supplied to said discharge lamp based on voltages supplied to said discharge lamp at at least two predetermined points of time after a time when a voltage supplied to said discharge lamp becomes minimum after discharge takes place, and wherein said first internal condition inferring unit infers said first internal condition of said discharge lamp before discharge based on said calculated changing rate.

17. An apparatus of claim 12, further comprising:

a measuring unit which measures a non-lighting time period during which said discharge lamp is turned off, and wherein said first internal condition inferring unit infers said first internal condition of said discharge lamp before discharge based on said measured non-lighting time period.

18. A method for lighting a discharge lamp, comprising:

inferring an internal condition of said discharge lamp;

adjusting a direct current voltage applying period to apply a direct current voltage to said discharge lamp based on said internal condition before applying said direct current voltage to said discharge lamp for the first time after receiving an instruction to start lighting said discharge lamp; and supplying said direct current voltage to said discharge lamp for said adjusted direct current voltage applying time period after receiving said instruction to turn on said discharge lamp.

19. An apparatus of claim 1, wherein said adjusting means includes a memory for storing pre-established relationships between said first internal state and information indicative of said direct current voltage applying period.

20. An apparatus of claim 1, further comprising:

an external condition detecting means for detecting an external condition of said discharge lamp, wherein said first internal state inferring means includes a memory for storing pre-established relationships between said external condition of said discharge lamp and information indicative of said first internal state of said discharge lamp.

21. An apparatus of claim 12, wherein said adjusting unit includes a memory storing pre-established relationships between said first internal condition and information indicative of said direct current voltage applying time period.

22. An apparatus of claim 12, further comprising:

an external condition detecting unit detecting an external condition of said discharge lamp, wherein said first internal condition inferring unit includes a memory storing pre-established relationships between said external condition of said discharge lamp and information indicative of said first internal condition of said discharge lamp.

23. The method of claim 18, further comprising:

storing pre-established relationships between said internal condition and information indicative of said direct current voltage applying period.

24. The method of claim 18, further comprising:

detecting an external condition of said discharge lamp; and storing pre-established relationships between said external condition of said discharge lamp and information indicative of said internal condition of said discharge lamp.

25. An apparatus according to claim 1, wherein said adjusting means adjusts said direct current voltage applying period to obtain an optimal direct current voltage applying period for initiating discharge in said discharge lamp specifically at said inferred first internal condition.

26. An apparatus according to claim 12, wherein said adjusting unit adjusts said direct current voltage applying period to obtain an optimal direct current voltage applying period for initiating discharge in said discharge lamp specifically at said inferred first internal condition.

27. The method of claim 18, wherein said adjusting step includes obtaining an optimal direct current voltage applying period for initiating discharge in said discharge lamp specifically at said inferred internal condition.

* * * * *